United States Patent [19]

Raftery

[11] Patent Number: 4,602,817

[45] Date of Patent: Jul. 29, 1986

[54] MODULAR FURNITURE SYSTEM

[75] Inventor: William B. Raftery, Arlington, Tex.

[73] Assignee: Steelcase Inc., Grand Rapids, Mich.

[21] Appl. No.: 494,568

[22] Filed: May 13, 1983

[51] Int. Cl.[4] ..... A47C 7/22

[52] U.S. Cl. ..... 297/440; 24/339; 297/248

[58] Field of Search ..... 211/182; 297/248, 249, 297/440; 105/64; 24/335, 336, 339, 265 C

[56] References Cited

U.S. PATENT DOCUMENTS

| | | | |
|---|---|---|---|
| 123,549 | 2/1872 | Brooks . | |
| 631,369 | 8/1899 | Hill | 297/249 |
| 712,898 | 11/1902 | Barney . | |
| 978,398 | 12/1910 | Rischard . | |
| 987,858 | 3/1911 | Collins . | |
| 1,198,726 | 9/1916 | Huntley . | |
| 1,241,922 | 10/1917 | Chappell | 24/339 |
| 1,470,811 | 5/1949 | Engleman . | |
| 1,510,805 | 10/1924 | Smith . | |
| 1,674,212 | 12/1928 | Loucks . | |
| 1,934,396 | 11/1933 | Bales . | |
| 2,011,521 | 8/1935 | Lorenz . | |
| 2,228,493 | 1/1941 | Will . | |
| 2,470,811 | 5/1949 | Engleman . | |
| 2,606,041 | 8/1952 | Misiak, Jr. . | |
| 2,628,384 | 2/1953 | Shomber . | |
| 2,637,081 | 5/1953 | Henrikson et al. . | |
| 2,643,840 | 6/1953 | Lanman . | |
| 2,799,907 | 5/1957 | Kohtz . | |
| 3,011,227 | 12/1961 | Vogel . | |
| 3,018,131 | 1/1962 | Krueger . | |
| 3,053,930 | 9/1962 | Mallanik et al. . | |
| 3,125,372 | 3/1964 | Rose . | |
| 3,141,699 | 7/1964 | Stafford . | |
| 3,144,271 | 8/1964 | Lieberman et al. . | |
| 3,162,484 | 12/1964 | Kleffman . | |
| 3,188,138 | 6/1965 | Lockshin . | |
| 3,194,600 | 7/1965 | Junkunc . | |
| 3,251,069 | 5/1966 | Clark | 24/356 |
| 3,309,258 | 3/1967 | Gallo . | |
| 3,312,438 | 4/1967 | Goetz et al. . | |
| 3,360,883 | 1/1968 | Glanzer . | |
| 3,382,545 | 5/1968 | Spenner . | |
| 3,383,738 | 5/1968 | Fox et al. . | |
| 3,387,343 | 6/1968 | Fitz-Gerald . | |
| 3,391,432 | 7/1968 | Du Rocher . | |
| 3,399,433 | 9/1968 | Faulkner . | |
| 3,425,567 | 2/1969 | Murray . | |
| 3,466,712 | 9/1969 | Behney . | |
| 3,485,467 | 12/1969 | Fuchs et al. . | |
| 3,488,432 | 1/1970 | Fernandes et al. . | |
| 3,492,046 | 1/1970 | Wittner et al. . | |
| 3,588,011 | 6/1971 | Peres et al. . | |
| 3,594,038 | 7/1971 | Polsky et al. . | |
| 3,636,595 | 1/1972 | Wines . | |
| 3,669,491 | 6/1972 | Weslock . | |
| 3,825,300 | 7/1974 | Lieberman et al. . | |
| 3,826,453 | 7/1974 | Hitchcock | 297/248 |
| 3,838,884 | 10/1974 | Faiks et al. . | |
| 3,893,729 | 7/1975 | Sherman et al. | 297/115 X |
| 3,907,239 | 9/1975 | Ehrlich . | |
| 3,916,089 | 10/1975 | Sloan . | |
| 3,983,602 | 10/1976 | Barry . | |
| 4,002,349 | 1/1977 | Dopp . | |
| 4,066,373 | 1/1978 | Workman . | |
| 4,077,666 | 3/1978 | Heumann . | |
| 4,124,251 | 11/1978 | Peterson | 297/440 |
| 4,195,942 | 4/1980 | Kestner . | |
| 4,232,899 | 11/1980 | Fister, Jr. . | |
| 4,325,526 | 4/1982 | Kitagawa | 24/336 |
| 4,352,255 | 10/1982 | Warehime . | |
| 4,358,080 | 11/1982 | Wolker . | |

OTHER PUBLICATIONS

1975–76, Car Shop Manual printed by the Ford Motor Company in Sep. 1975, pp. 41-60-5 through 41-60-9 of vol. 4.

*Primary Examiner*—William E. Lyddane
*Assistant Examiner*—Joseph Falk
*Attorney, Agent, or Firm*—Price, Heneveld, Huizenga & Cooper

[57] ABSTRACT

The specification discloses a modular furniture system in which a modular furniture assembly is made of a pair of elongated base frames to which a support element is mounted to serve as a chair, seat, table, or the like. Front and rear shrouds are secured over the base frames to mask them from view and end panels are provided to cover either or both sides depending on whether the unit is to be ganged against other units. Upholstery covering is provided which utilizes a unique strip hook for securing to a cross piece on the base frames and which includes front and rear "button" flanges for slipping into a space between the shroud at the front or rear of the chair and the support member. The "button" flange or strip is then rotated so that it cannot be removed from the gap into which it was inserted. A unique toggle flange ganger clip is provided for ganging adjacent module units together.

66 Claims, 29 Drawing Figures

MODULAR FURNITURE SYSTEM

BACKGROUND OF THE INVENTION

The present invention relates to furniture construction, and in particular to a modular furniture arrangement for constructing single unit seating, benches and tables as well as multi-unit arrangements.

The use of standardized components to fabricate modular furniture arrangements has been used in the past in order to produce furniture that can be used as an individual unit or ganged together into multi-unit assemblies. Such modular arrangements reduce the overall cost of furnishings, particularly for commercial seating and the like and also increase the flexibilty of use for such furnishings in that the same furnishings can be separated for use in small areas or ganged together for use in larger areas.

Heretofore, such modular systems have allowed some interchangeability of elements but typically do not allow interchangeability of components between different types of furnishings. Often such furniture systems produce a tacked-on appearance, in that the various modules or elements are visibly connected rather than presenting a finished appearance replicating manufacture as a single unitary furnishing.

Another problem encountered with such modular systems is that if the ganging means is obscured sufficiently to give the ganged furnishings a solid unitary appearance, the individual modules cannot be easily separated or connected for alternative uses of the furnishings. Ganging clips or other devices are often difficult to attach or remove from individual furniture units. If the ganging clips are easily removable, the clips often will not hold the individual units together solidly.

Still another problem encountered with many modular systems is that when such furnishings receive extensive use, various elements of the furnishings wear or become damaged, requiring expensive repair or replacement of large portions of the modular unit. Particularly prone to such wear and damage is the upholstery which receives direct contact and is more easily damaged than other portions.

SUMMARY OF THE INVENTION

The present invention provides an article of furniture which has a pair of base support frames to which a structural support member is joined to provide a unitized structural assembly. The base frames are masked by shroud members secured over the frames so that the furniture has an overall unitary appearance. Additionally, the structural support may be interchangeable with various other structural support members of different configurations so that the article of furniture can be utilized as either a seat, bench or table. This allows numerous elements to be used interchangeably on different types of furniture.

In another aspect of the invention an article of furniture is provided in which a number of individual modular units are ganged together by a ganging means that is masked from view by a masking means. When the pieces of furniture are so ganged, although the ganging means is not readily visible, access can be had to the ganging means from the exterior of the piece of furniture without moving the furniture. Preferably, the ganging means is accessible through an aperture that is located in a recess at the base of the furniture such that the aperture and ganging means positioned within are not visible from normal eye level.

In another aspect of the invention a ganging clip is provided which has a plurality of spaced ganging seats and a toggle flange extending to one side of the ganging seats. Preferably, a toggle flange extends to both sides of the ganging seats to be symmetrical. The toggle flange is used as a lever to pivot the clip about the seat furthest removed from the toggle flange.

In another aspect of the invention an upholstery attaching system is provided in which a piece of upholstery has a securing means that allows an edge of the upholstery to be selectively secured between the shroud and the support member. The upholstery is hand securable and releasable from between the shroud and the support member. This securing means is preferably a strip of semi-rigid material attached to an edge of the upholstery. The strip has a width greater than its thickness so that the strip can be slid between the shroud and support member and then be rotated so that the strip width will prevent the upholstery end from being removed. Preferably, the upholstery has elongated hooks attached to either side for hooking under a cross piece on a furniture base runner.

This modular furniture system allows various components to be interchangeable between different types of furniture as well as being interchangeable between different pieces of the same type of furniture. With this arrangement, a reduced number of elements support the weight of objects placed on the furniture so that the structural strength of the other elements may be reduced. The system provides furniture which has an overall unitary appearance, whether the furniture is used a a single unit or ganged together into a multi-unit piece. Thus, the furniture presents a finished appearance rather than an unfinished, tacked together appearance.

Since the various elements are interchangeable, a single element can be removed for replacement or repair. This is particularly beneficial in the case of the upholstery which can be easily removed and replaced while still presenting a permanently attached appearance. This is desirable in that the upholstery may be subjected to a higher degree of wear than other elements of the furniture and also can be torn more readily than other solid elements.

In spite of the unitary appearance, the ganging means is readily accessible from the exterior of the furniture so that the modular units can be quickly rearranged for alternative uses. Such interchangeability of elements allows a user to keep a smaller inventory of replacement parts on hand while maintaining a high degree of flexibility of alternative uses.

The ganger clip embodied by the present invention also adds to the unitary appearance of the ganged pieces of furniture. The ganger provides a positive, solid locking of separate furniture units so that the units do not appear to be tacked together. Yet the toggle flange of the ganger clip allows the clip to be readily attached and removed by acting as a lever to pivot the clip.

These and many other advantages of the various aspects of the invention will be further understood and appreciated by those skilled in the art by reference to the following written specifications, claims and appended drawings.

DETAILED DESCRIPTION OF THE PREFERRED EMBODIMENTS

Figure 1:
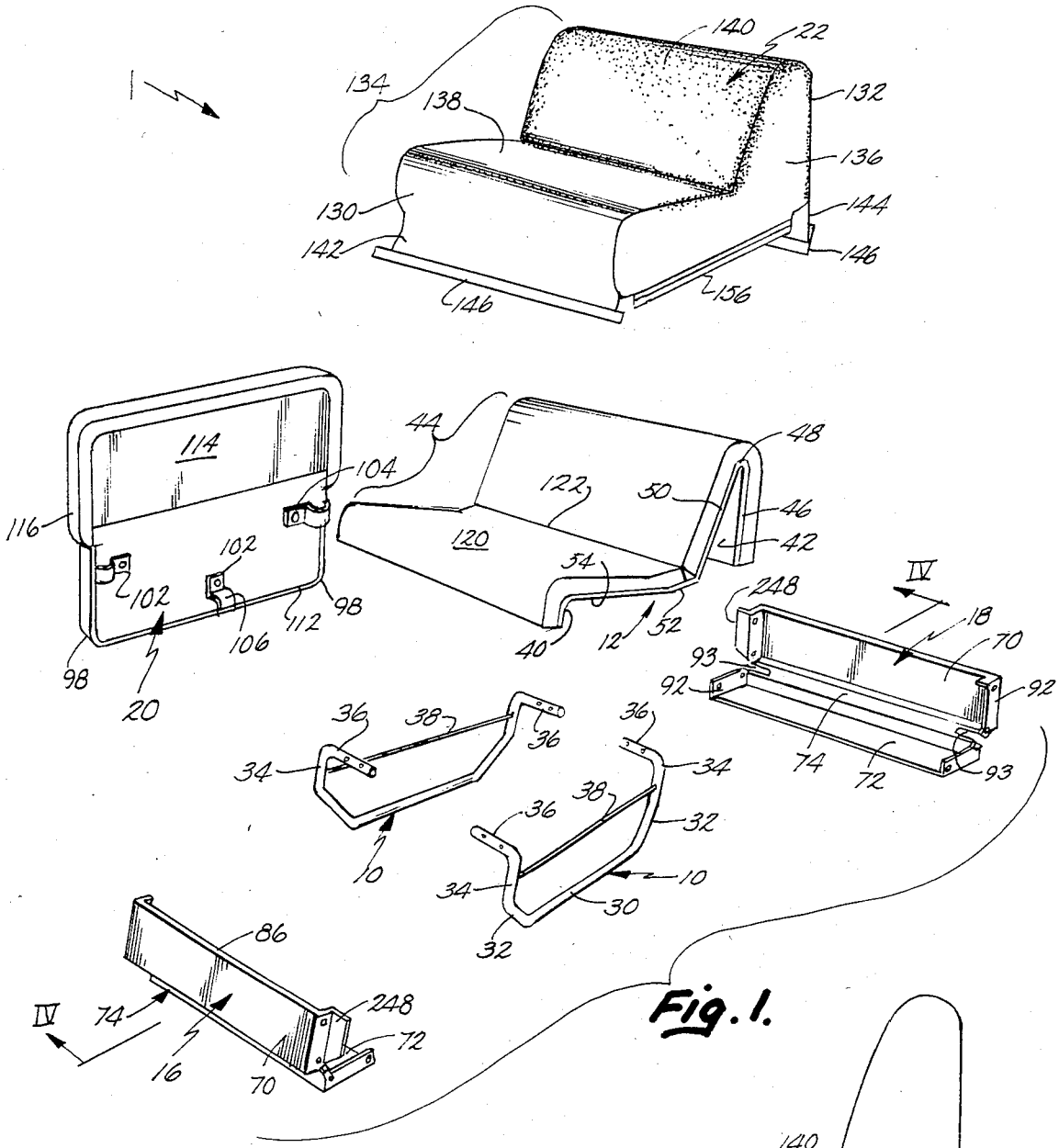
FIG. 1 is an exploded perspective view of a chair made in accordance with a first embodiment of the present invention.

The Chair of FIG. 1

Figure 12:
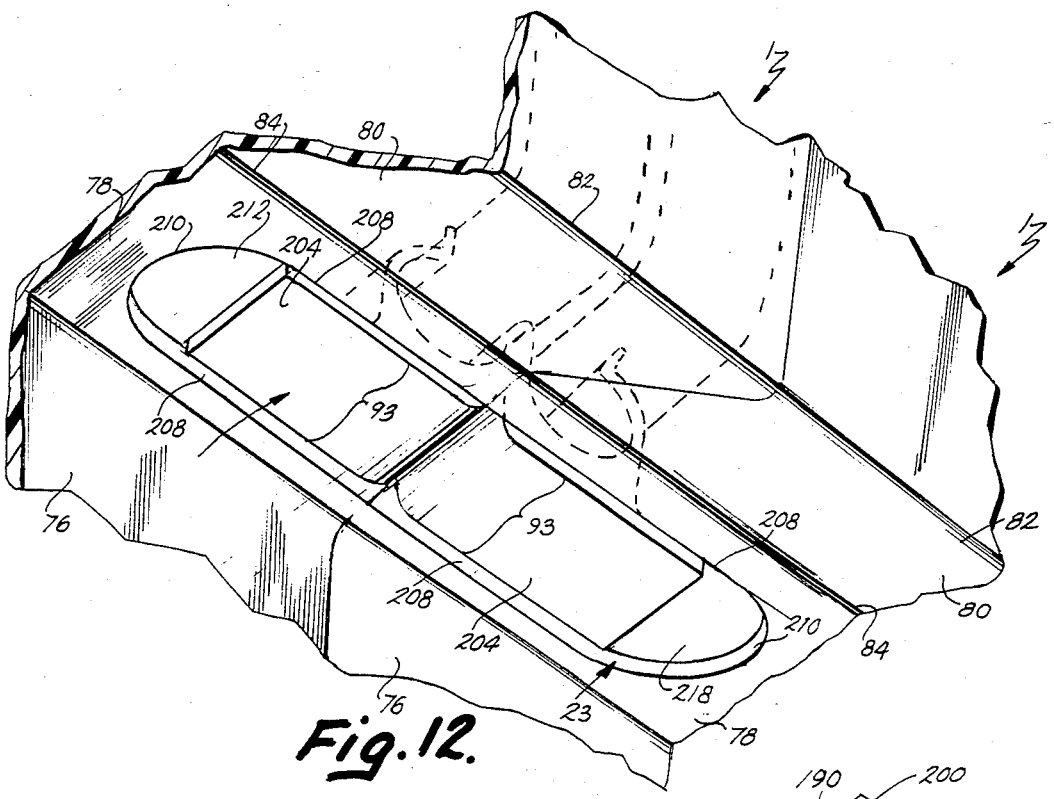
FIG. 12 is a fragmentary, perspective view taken generally in the direction of arrow XII in FIG. 3, showing the area of the base of adjoined furniture units 1 where a ganger clip joins the two units.
Figure 13:
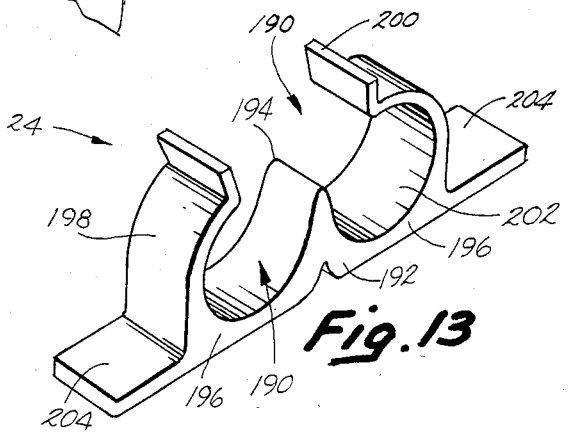
FIG. 13 is a perspective view of the ganger clip shown in FIG. 12.
Figure 14:
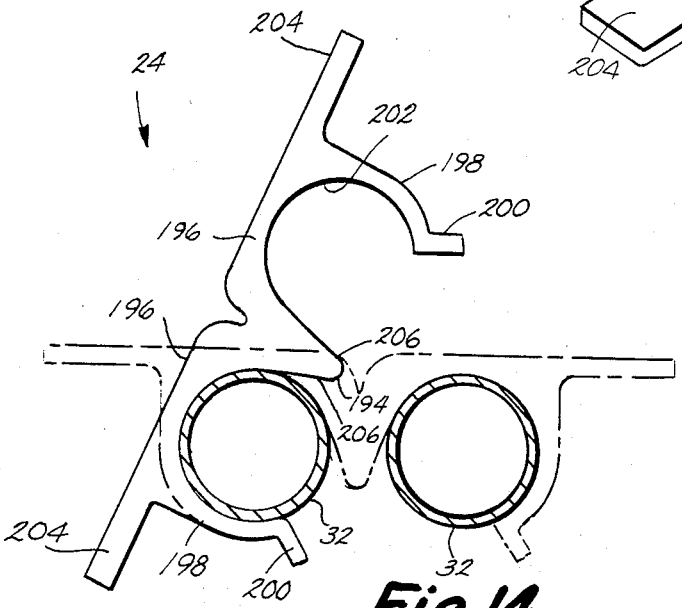
FIG. 14 is an elevational view of a ganger clip coupling two base frames, which are shown in cross section.

In a preferred embodiment (FIG. 1), a modular furniture assembly 1 has a pair of spaced, elongated base frames 10 to which the various other elements are secured. A support element 12 is joined to base frames 10 to provide a support surface for the objects to be placed upon furniture assembly 1. Front and rear shrouds 16 and 18 are secured over base frames 10 in order to mask base frames 10 and give modular furniture assembly 1 an overall unitary appearance. An end panel and arm assembly 20 is secured to base frame 10 at one side of unit 1. The other side may be similarly shrouded or abutted against an adjacent unit 1. Since unit 1 is a chair, support 12 is shaped with seat and back portions which are covered with foam cushions 120. An upholstery cover 22 is fitted over cushions 120 and support element 12 to provide a finished appearance. Two such units 1 can be ganged together using ganger clip 24 (FIGS. 12–14).

Both left and right base frames 10 (FIG. 1) are identical so that the various base frames may be interchangeably used on either side of furniture assembly 1, or can be used with different support elements 12. Each base frame 10 is a bent tubular steel member having an elongated floor engaging portion 30. From either end of floor engaging portion 30, angled sections 32 extend upwardly and outwardly. Extending straight upward from each angled section 32 is an upright section 34 and extending to the side of each upright section 34 is a mounting section 36 to which support 12 is mounted. Both mounting sections 36 on each base frame 10 extend to the same side at a right angle relative to upright sections 34 and to floor engaging portion 30.

Each base frame 10 has a cross piece 38 which extends between upright sections 34. In the embodiment shown in FIG. 1, cross piece 38 is a circular steel rod which is secured to upright sections 34 by conventional means such as welding. It gives strength to base runner 10 and also serves as a mount for upholstery 22, as more fully explained below.

Figure 3:
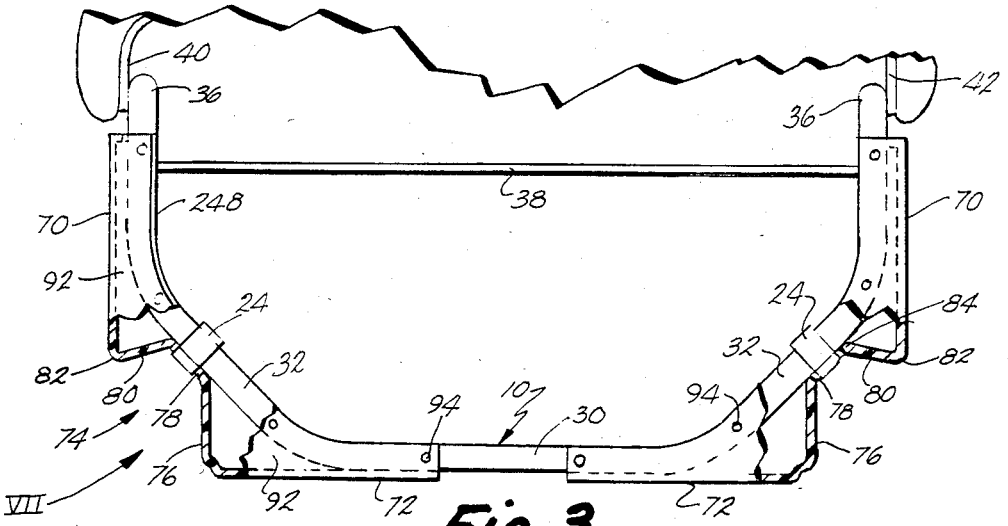
FIG. 3 is a side elevational, fragmentary view generally of the area III of FIG. 2, showing the base portion of the assembled chair of FIG. 1 without upholstery in place.
Figure 4:
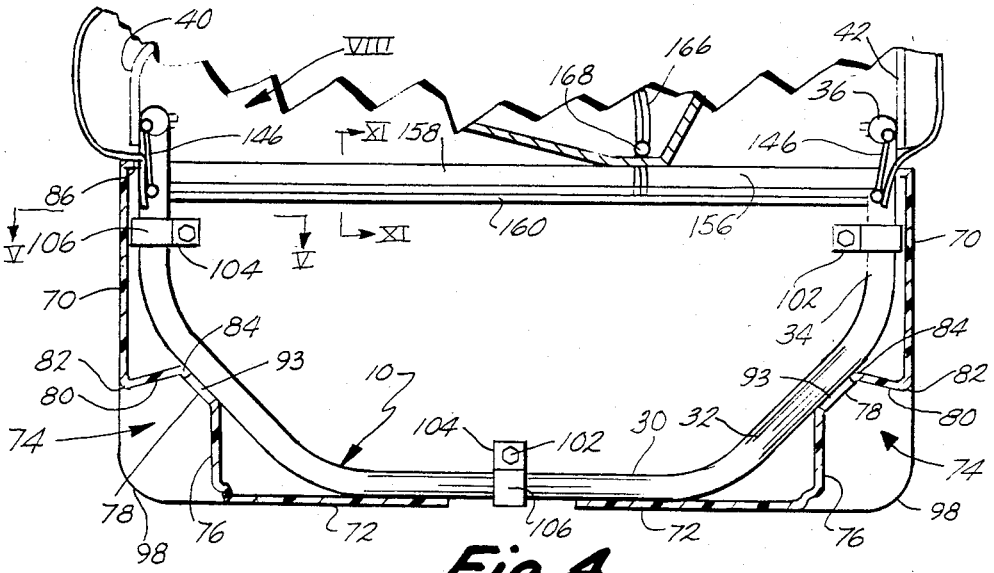
FIG. 4 is a fragmentary sectional view of the base portion of the assembled chair of FIG. 1 taken along plane IV—IV of FIG. 1, with upholstery in place.

Support element 12, is made of bent plywood and has a front mounting flange 40, a back mounting flange 42 and a central supporting area 44 therebetween. Both front and back mounting flanges 40, 42 are generally vertical, planar sections which are spaced sufficiently to snuggly receive base mounting sections 36 of base 10 therebetween, as also shown in FIGS. 3–4. Front and back mounting flange 40 and 42 are bolted to mounting sections 36 of base frames 10. Thus, the entire weight of support element 12 and objects placed on element 12 is supported by frames 10.

Figure 23:
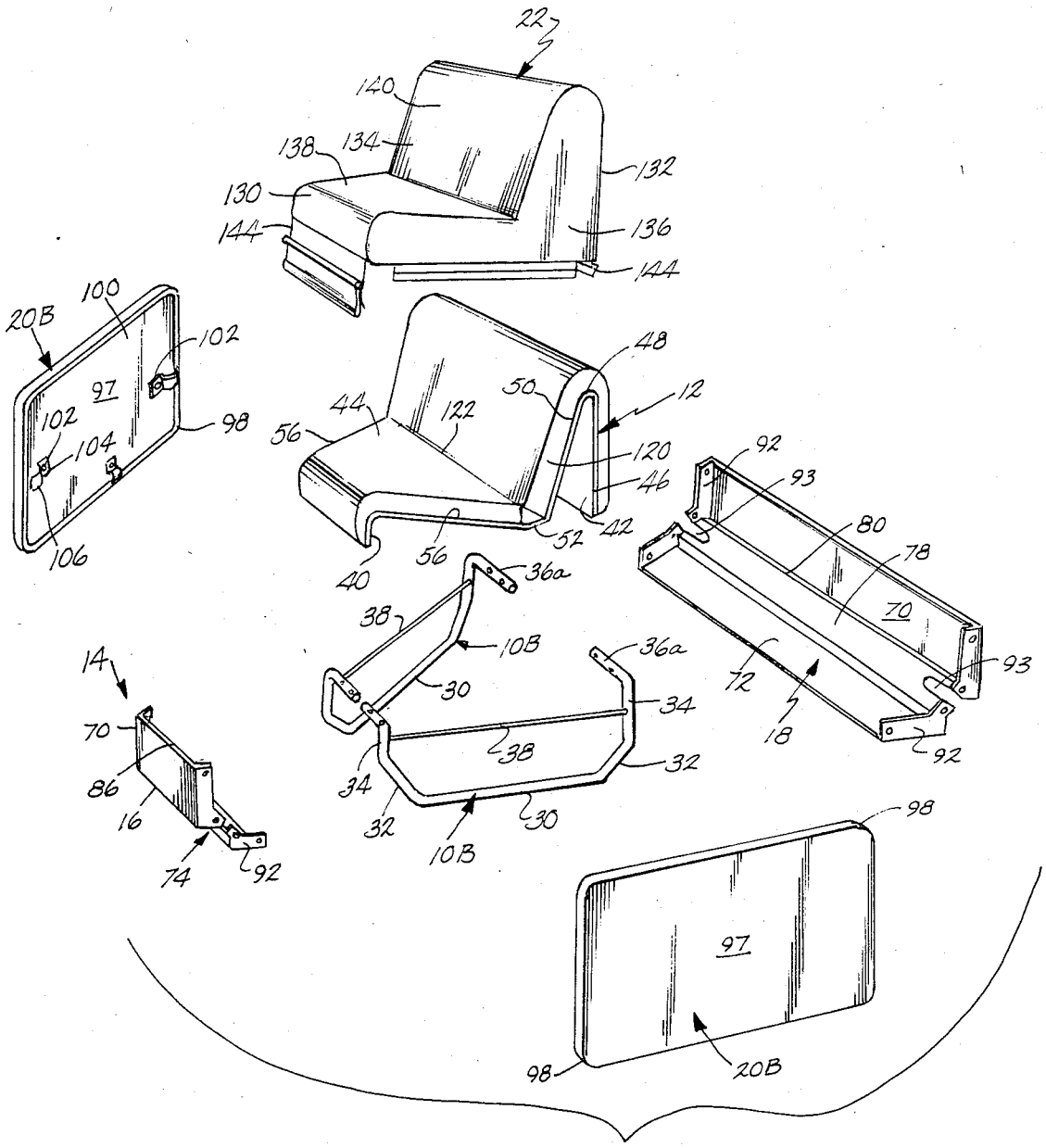
FIG. 23 is an exploded, perspective view of a corner chair made in accordance with the present invention.
Figure 24:
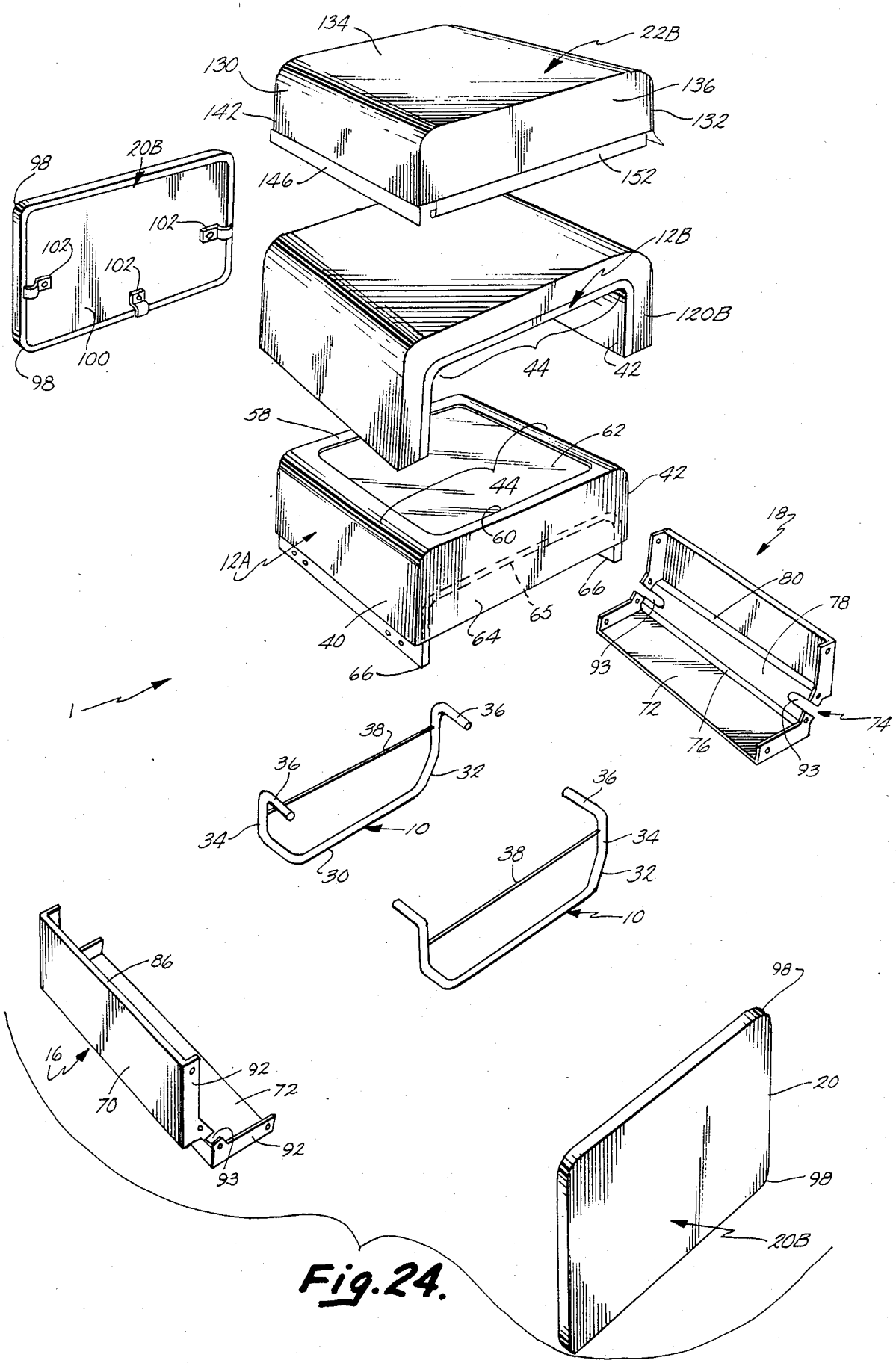
FIG. 24 is an exploded, perspective view of a seat (or table) made in accordance with the present invention.

As can be seen by comparing FIGS. 1, 23 and 24, central supporting area 44 can have a variety of configurations depending upon the use furniture assembly 1 is to be put to. In FIG. 1, support element 12 is a chair seat having an upwardly extending rear panel 46 that is an extension of back mounting flange 42. Rear panel 46 terminates in a curved top 48 which curves down into an angled back rest 50. Extending to the side of angled back rest 50 and away from rear panel 46 is a generally horizontal seat section 52, from which extends an upwardly angled seat section 54 that has a smoothly curved front joining with front mounting flange 40.

Front shroud 16 is identical to back shroud 18 so that the two elements are interchangeable. Shrouds 16, 18 are vacuum formed ABS (acrylonitrile-butadienestyrene copolymer), or more preferably are injection molded. Each shroud 16, 18 has a vertical face 70 and a horizontal base plate 72 which are generally rectangular in shape. Face 70 and base plate 72 are joined by a recessed corner 74 that extends generally along the entire length of shroud plate 16, 18 and creates a toe recess below face 70.

As is shown in FIGS. 3 and 4, each recessed corner 74 is defined by a generally upright or vertical wall 76 which joins with a forwardly and upwardly sloping ganging wall 78, so named because it is through openings 93 at each end of this wall that ganging is facilitated. An angled covering wall 80 slopes forwardly and downwardly from its juncture 84 with ganging wall 78 and joins with face 70 at a juncture 82 that is poisitioned lower than juncture 84. Thus, the lower portion of face 70 hangs down in front of angled ganging wall 78 so that ganging wall 78 and clip openings 93 therein are not normally visible when furniture assembly 1 is in normal use. Although angled covering wall 80 does slope forwardly and downwardly, angled covering wall 80 is generally horizontal relative to vertical wall 76 in order to produce recessed corner 74.

Figure 5:
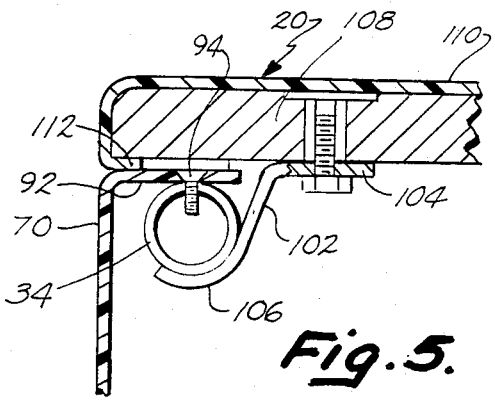
FIG. 5 is a fragmentary, plan sectional view of the joint between a rear shroud, end panel and a base frame, taken along plane V—V of FIG. 4.
Figure 15:
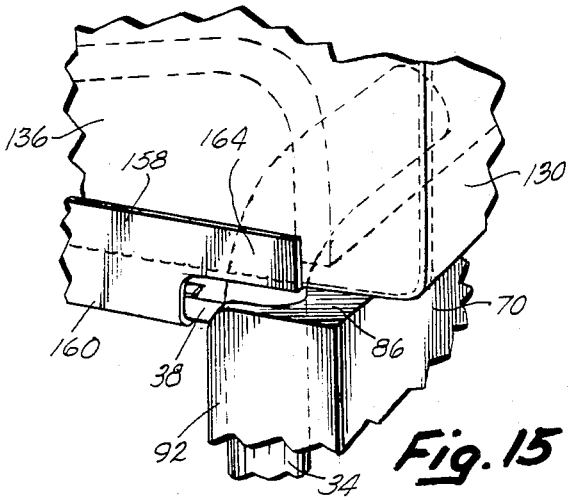
FIG. 15 is a fragmentary, perspective view of the corner portion of the chair designated XV in FIG. 2.

Each shroud 16, 18 has a narrow top 86 which extends rearwardly from the top of front face 70 and which has a curved notch 88 adjacent either end (FIG. 1). Notches 88 accommodate base runners 10, specifically upright section 34 when shroud 16, 18 is secured to base runners 10. (See also FIG. 15). Along either side of face 70, base plate 72 and recessed corner 74 are sides 92 (FIGS. 1, 3 and 15). The free edge of side 92 is smoothly curved to compliment the curve of base frames 10. Sides 92 have spaced apertures through which shroud plates 16, 18 are secured to base frames 10 by screws 94 (FIGS. 4, 5). Since screws 94 pass through sides 92, no visible connecting means are exposed on front face 70 or the exposed portion of recessed corner 74. When secured to base frames 10, shrouds 16, 18 mask frames 10 from the front and back.

Each clip opening 93 at each end of ganging wall 78 extends also through side 92. Clip openings or notches 93 are used in the ganging together of multiple furniture assemblies as described in detail below.

Figure 2:
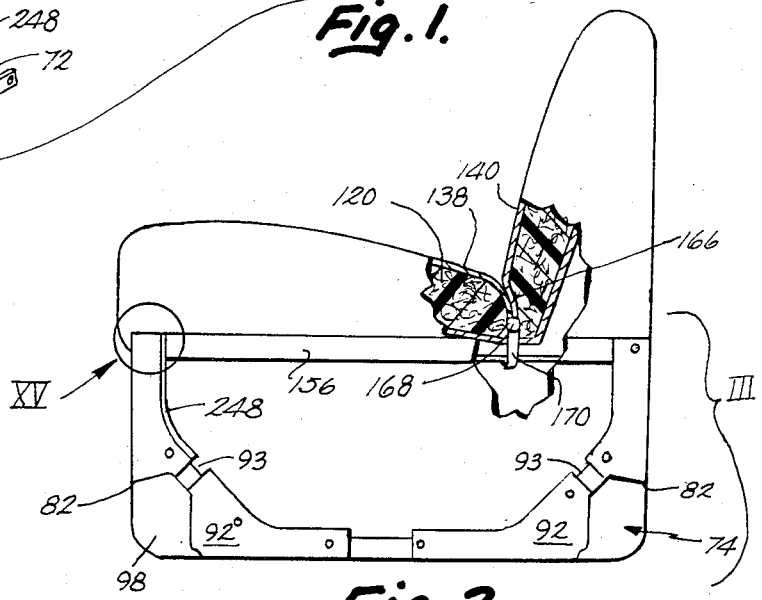
FIG. 2 is a side elevational view of a partially assembled chair embodying the present invention with a portion of the upholstery partially broken away.
Figure 7:
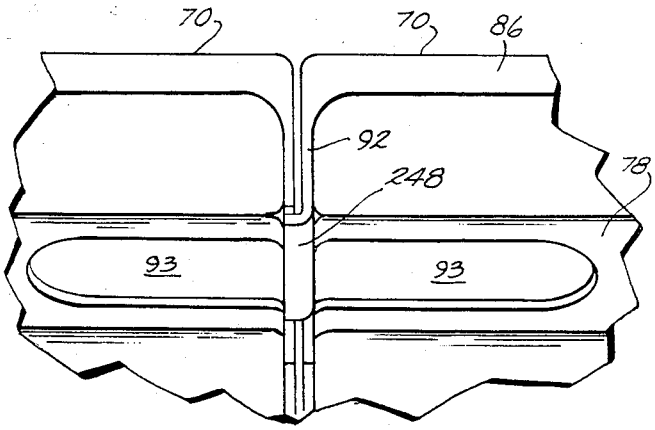
FIG. 7 is a fragmentary, top plan view of abutted front shrouds ganged together.

One side wall 92 of each shroud plate 16, 18 has an interlock flange 248 or lip that extends laterally outward from the terminal edge of side 92 (FIGS. 1, 2, 6 and 7). Interlock flange 248 extends upward from clip opening 93. Since interlock flange 248 is located on only one side of shroud plates 16, 18, when two furniture assemblies 1 are ganged together, a side 92 having interlock flange 248 will abut a side 92 without flange 248, FIG. 7. As shown in FIGS. 1 and 2, shroud plates 16, 18 are interchangeable so that flange 248 will simply be on the opposite side of the shroud plate when it is moved from the front to the back of assembly 1. When sides 92 are abutted as shown in FIG. 7, interlock flange 248 prevents one of the shrouds 16, 18, from moving forward of the adjacent shroud 16, 18. This aids in the assembly of furniture assembly 1 and also maintains a unitary appearance of the furniture piece when various units are ganged together.

End panel 20, (FIG. 1) has a generally rectangular lower portion 97 with rounded bottom corners 98, and an upper arm portion 114. Panels 20 have a height greater than the distance that cross piece 38 is spaced above floor engaging portion 30 of base 10, so that when secured to base frames 10, panels 20 and shroud plates 16, 18 form a masking shroud that has a unitized appearance and that completely hides base frames 10. The lower portion 97 of each panel 20 has a connecting clamp 102 bolted adjacent either side at a height corresponding to upright sections 34 of base frames 10. A third clamp 102 is bolted adjacent the bottom edge of panel 20 approximately at its midpoint, for connection to floor engaging portion 30 of base 10. Each clamp 102 (FIG. 5) has a flat bolting flange 104 which is bent outward into a semicircular clamping flange 106. Clamping flange 106 has a radius of curvature corresponding to the outer radius of the tubular stock of base frame 10 to allow connecting clamps 102 to be bolted thereover and securely clamp end panels 20 to base frames 10.

Preferably, panels 20 have rigid inner core 108 of plywood or the like (FIG. 5) and an outer cover layer 110 of vacuum formed ABS or the like. Cover layer 110 extends all the way around the outer edge of core 108 to an inside terminal lip 112, so that when panel 20 is clamped onto base frames 10, lip 112 firmly abuts sides 92 of shroud plates 16, 18. This provides a unitized, solid finished appearance to the furniture assembly 1.

Alternatively, cover layer 110 may be formed without lip 112. Cover layer 110 will extend all the way around the outer surface and edges of the core 108 and stops flush to the inside surface as shown with an alternative embodiment of FIG. 20*a*. This corner edge is finished 113 to provide a unitized solid finished appearance to the furniture assembly 1. This is the preferred embodiment.

Core 108 extends upwardly to define arm rest portion 114 on end panel 20 (FIG. 1). Secured to the top and sides of arm rest portion 114 is a widened arm rest plate 116. Arm rest plate 116 has smoothly curved corners to provide a complimentary appearance to the lower portion of end panel 20. Arm rest plate 116 provides a widened surface which will not dig into a person's arm. Arm rest plate 116 is upholstered, as is the inside of arm rest portion 114, down to a line beneath the surface of foam cushion 120 in order to provide a finished appearance to assembled furniture assembly 1. The outside of arm rest portion 114 is covered by cover layer 110.

End panel 20 can be made in an armless version as well (see end panel 20B in FIG. 23). One merely shortens core 108 and correspondingly cover 110 to eliminate upper arm portion 114.

Attached to the upper surface of support element 12 is a foam cushion 120 (FIG. 1). Cushion 120 can be affixed to support element 12 in any conventional manner, as by adhesive. Cushion 120 covers the entire upper, front and/or outer surface of support 12, and may be a single configured cushion or several separate pieces. As shown in FIG. 1, cushion 120 is preferably made of two sections having a break 122 extending the width of support element 12 between horizontal seat section 52 and angled back rest 50. This facilitates upholstery mounting as will be explained below.

Upholstery 22 has a configuration dependent upon the configuration of the particular support element 12 utilized with furniture assembly 1. Upholstery 22 of FIG. 1 chair 1 has a front section 130, a back section 132 and a central section 134. Stitched on either side of front, back and central sections 130–134 are two side sections 136. As shown in FIG. 1, upholstery central section 134 has a seat 138 and a back 140 which are complimentary to back rest 50, horizontal seat section 52 and angled seat section 54 of chair seat support 12. Upholstery 22 therefore forms a hood which can be easily slid over cushion 120 and support 12 and which will snuggly enclose these elements.

Figure 8:
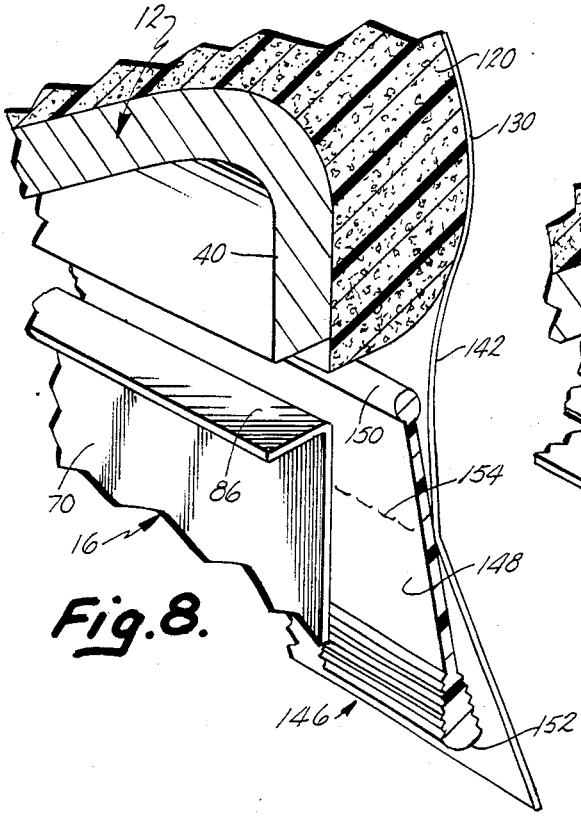
FIG. 8 is a fragmentary, sectional perspective view taken generally in the direction of arrow VIII in FIG. 4, showing an upholstery securing strip as it is about to be inserted in the narrow space between the seat support and front shroud.
Figure 9:
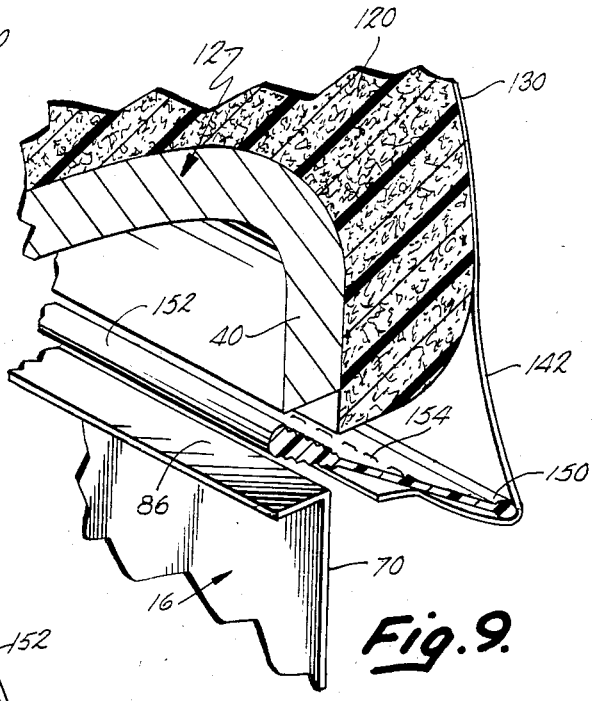
FIG. 9 is the same view as FIG. 8 but with the upholstery securing strip being inserted in the aforesaid narrow space.
Figure 10:
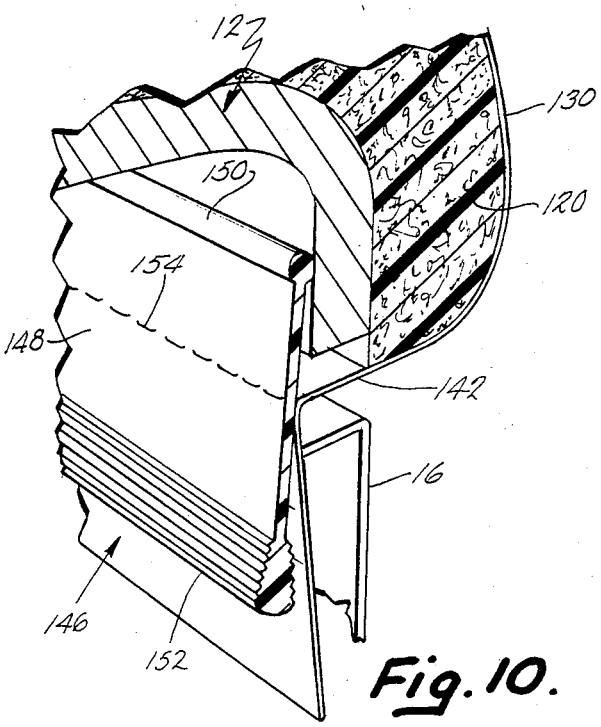
FIG. 10 is the same view as FIG. 8 with the securing strip in its inserted position.

Depending from front and back upholstery sections 130 and 132 respectively are a front securing flap 142 and a back securing flap 144 (FIG. 1). Stitched onto each securing flap 142, 144 is an elongated securing strip or button 146. Strip 146 is a strip of at least semi-rigid material such as plastic that extends along the entire length of securing flap 142, 144. As shown in FIG. 8, strip 146 has a thin body portion 148 with a rounded bead edge 150 running along one edge and a generally triangular shaped, knurled grasping flange 152 extending along the opposite edge. Securing strip 146 is relatively thin so it can be inserted into the narrow space between the bottom of mounting flange 40 on support 12 and surface 86 of on shroud 16 (FIG. 9). Strip 146 is stitched to securing flap 142, 144 along a line 154 is generally in the center of strip 146 such that strip 146 can be inserted flat into the space between mounting flange 40 of support 12 and surface 86 of shroud 16 and then rotated 90° so as to be trapped behind said flanges (FIG. 10). Knurled grasping flange 152 provides a ready handgrip for grasping strip 146 when strip 146 is being inserted. This process would be the same for inserting flap 144 between rear shroud 18 and rear mounting flange 42.

Figure 10A:
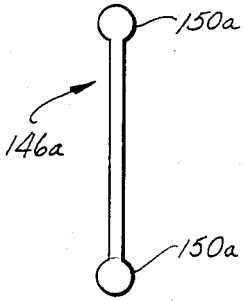
FIG. 10*a* is a side elevational view of an alternative upholstery securing strip.

In the alternative, a securing strip **146*a* is used having a rounded bead 150*a* on both edges, FIG. 10*a*. Preferably, when the extrusion with a rounded bead 150a on both edges is used, sufficient material is provided so the material flap may be inserted between mounting flange 40 of support 12 and surface 86 of shroud 16 and then pulled through sufficiently to allow strip 146*a* to rotate 90° so as to be trapped behind flange 40 and top surface 86**.

Stitched to the bottom of either side section 136 of upholstery 22 is an elongated hook 156, also extruded of a suitable plastic, (FIG. 1) extending generally the length of side flap 136. Each side hook 156 has an upright flange 158 (FIG. 11) by which hook 156 is stitched or otherwise connected to side section 136. At the base of upright flange 158 is a curved hook portion 160 that terminates at its free end in an outwardly entending snap flange 162. Side sections 136 extend downward sufficiently far that hooks 156 can hook under cross pieces 38 of base frame 10 and pull side sections 136 taut. As shown in FIG. 15, the ends of upright flanges 158 extend further along side 136 than hook portion 160 to form an end tab 164. End tabs 164 help pull the ends of upholstery sides 136 taut adjacent front and back sections 130 and 132, even though hooks 160 cannot extend to the ends due to interference with upstanding portion 34 of base frame 10.

Seat section 138 and back section 140 are sewn at their juncture to define an intermediate flap 166 having a length not greater than the thickness of cushion 120 (FIG. 2). At the free end of intermediate flap 166 is a stiff rod 168 which extends along the entire length of flap 166 to keep the surface of upholstery 22 taut. At either end of rod 168 is a hook and loop fastener strip 170. Fastener strip 170 has a length sufficiently long that when flap 166 and rod 168 are pulled down in between break 122 in cushion 120, fastener strip 170 can connect with a mating strip attached to the undersurface of seat support 12. These strips are interlocking fabric strips such as "Velcro".

Figure 17:
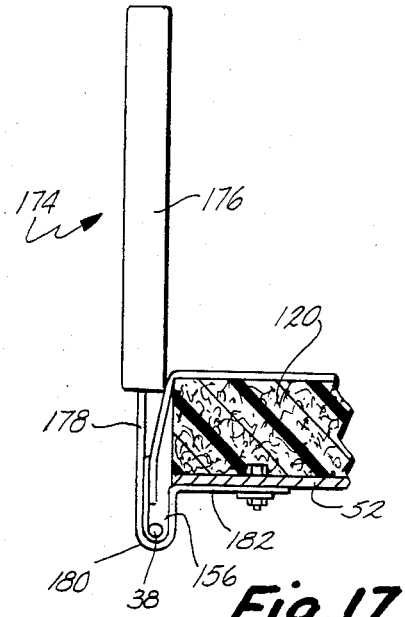
FIG. 17 is a fragmentary sectional view taken generally along plane XVII—XVII of FIG. 16.
Figure 16:
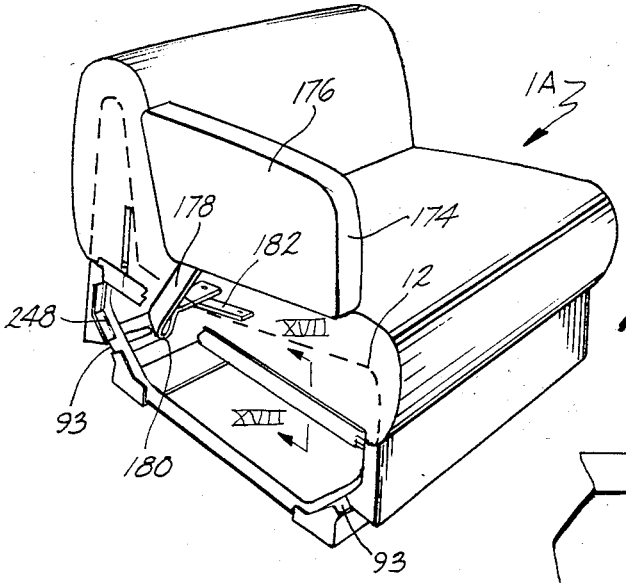
FIG. 16 is a perspective partially broken view of a chair with center arm.

Chair With Center Arm (FIGS. 16, 17)

Ganger clips 24 (FIG. 13) are used to secure two modular furniture units 1 together. Each ganger clip 24 is of molded nylon and has two adjacent, circular seats 190 which are sized to tightly hold two angled sections 32 of base frames 10, FIGS. 12 and 14. Seats 190 are separated by a center flange 192 that has a top edge 194. Seats 190 each have a base 196 which join center flange 192 and upwardly from which extend a pair of spaced outer flanges 198. Each outer flange 198 is curved in at its free end toward center flange 192, and also has at its free end a reverse bend snap flange 200. A toggle flange or lever arm 204 extends outwardly from base 196 on either side of clip 24.

The opening formed between the free end of each outer flange 198 and center flange top edge 194 is less than the diameter of angled sections 32 of base frame 10. Thus, when an angled section 32 is seated in seat 190, outer flange 198 holds section 32 in place. Snap flange 200 angles outward from outer flange 198 along a radius of seat 190 which forms an angle A of approximately 25° with the line perpendicular to base 196 (FIG. 14). On either side of center flange top edge 194 are recurved faces 206, which curved away from the semi-circular curvature of the remainder of seats 190. Each snap flange therefore combines with a recurved face 206 to form a funneled opening to seat 190 in order to allow for a smooth insertion of an angled section 32 into seat 190. Clip 24 is made from a resilient material to allow the flanges to resiliently deform when attaching clip 24, but which will firmly hold frames 10 in seat 190 when so affixed.

Clip notches 93 on shrouds 16, 18 are used to permit access to base frames 10 in order to attach ganging clip 24 (FIGS. 1 and 2). Clip notches 93 in shroud plates 16, 18 have spaced sides 208 which are joined by a curved end 210 (FIG. 12). The width of clip 24 is less than the spacing between notch sides 208, so that clip 24 can be passed easily through notch 93. As shown in FIG. 12, when two shroud plates 16 or 18 are abutted the distance between the two adjacent notch ends 210 is greater than the length of clip 24. Thus, when clip 24 is inserted into abutted notches 93, an access aperture 212 is formed on either side of clip 24 which facilitates subsequent removal of clip 24 if necessary.

The construction of clip 24 allows one seat 190 to be clipped over a first angled section 32 as shown in FIG. 14, and then be rotated on the secured angled section 32 until it is clipped over a second adjacent angled section 32 by pushing against a toggle flange 24. Access apertures 212 are large enough that to remove ganger clip 24 a finger can be passed through access aperture 212. Using a toggle flange 204 as a lever and one angled section 32 as a fulcrum, clip 24 can be snapped off of the nearer angled section 32. The body of clip 24 can then be grasped to pull clip 24 off of the remaining angled section 32.

In another alternative embodiment shown in FIGS. 16 and 17, modular furniture assembly 1A is a chair with an intermediate arm member 174 instead of an end panel arm 20 as shown in FIG. 1. Arm 174 is intermediate in that when several individual modular furniture units, including 1A, are ganged together as described below, arm 174 is positioned between two units. Arm member 174 has a roughly rectangular body 176 that is configured to smoothly follow the contour of seat support element 12 and cushion 120. Depending from the base of body 176 is a support bracket 178 having at its lower end a recurved hook 180. Recurved hook 180 extends upward and at its free end has a connecting flange 182 that extends to the side of support bracket 178 and hook 180. Flange 182 is connected by bolt 184 to the underside of horizontal seat section 182 of chair seat support element 12. Preferably bracket 178 is bent of flat bar stock to fit easily between ganged modular furniture units 1. Hook 180 is spaced below body 176 sufficiently that cross piece 38 and side hook 156 can pass through hook 180 without interference.

Alternative Base Frame (FIGS. 18–22)

Figure 19:
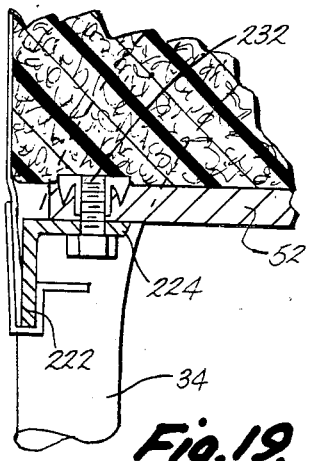
FIG. 19 is the same view as FIG. 11, but with the alternative embodiment base frame of FIG. 18 being substituted.
Figure 18:
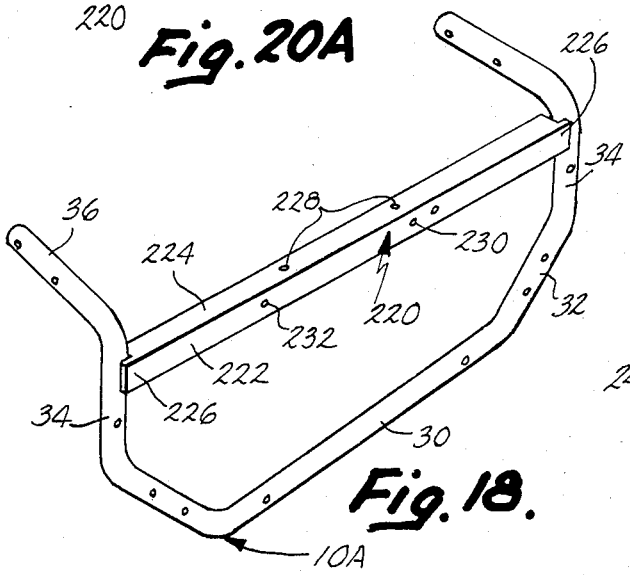
FIG. 18 is a perspective view of an alternative embodiment base frame.

FIG. 18 shows an alternative base frame 10A which is identical to base frame 10 except that circular rod cross piece 38 is replaced with an L-shaped beam 220. Beam 220 is a length of angle iron having a vertical flange 222 and a horizontal flange 224 (FIG. 19). Vertical flange 222 extends slightly past the ends of horizontal flange 224 to produce connecting tabs 226 which can be secured to upright sections 34 of base frame 10A in a conventional manner, as for example by welding. Horizontal flange 224 has two spaced apertures 228 which are used to connect beam 220 to horizontal seat section 52 of a chair support element 12. Vertical flange 222 has two spaced apertures 230 which are used to connect other elements to the side of beam 220 as described below.

Figure 22:
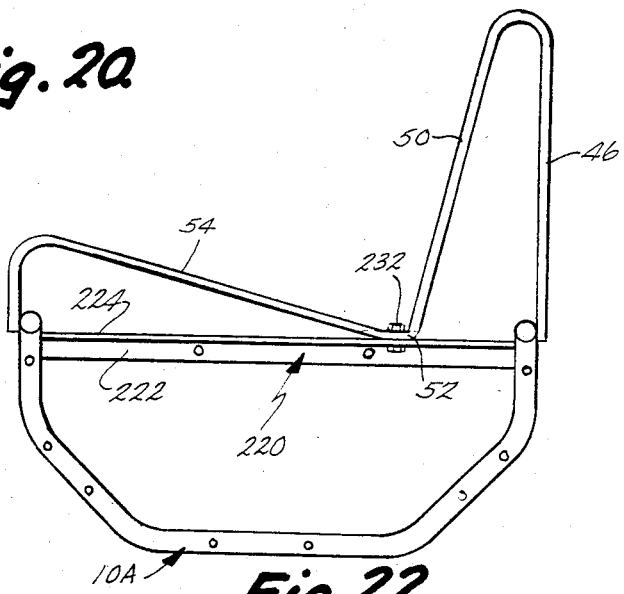
FIG. 22 is a cross sectional view taken along plane XXII—XXII of FIG. 20, but with upholstery and cushioning and front and rear shrouds removed from the chair.

As shown in FIGS. 19 and 22, horizontal seat section 52 of chair seat element 12 is bolted to horizontal flange 224 by a bolt 232 that passes through one of the apertures 228. Since horizontal seat section 52 is closer to back connecting area 42 than it is to front connecting area 40, FIG. 22, bolt 232 passes through the rearward one of apertures 228, as viewed in FIG. 22. Two apertures 228 are provided so that base frames 10A can be interchangeable for use on either side of furniture assembly 1. The other aperture 228 would be used if base frame 10A were used on the opposite side of furniture assembly 1. This intermediate bolting of support 12 to beam 220 provides additional support to support surface 12. Support 12 can thus be made of a thinner material than a support 12 mounted on base frame 10. Hence in this respect, base frame 10A is a more preferred embodiment.

In furniture units using a cross piece "L" beam 220, as shown in FIG. 19, side sections 136 of upholstery 22 are hooked under vertical flange 222 by elongated side hook 156. Side hook 156 hooks under vertical flange 222 in the same manner as described above and maintains side section 136 in a taut condition.

Figure 20:
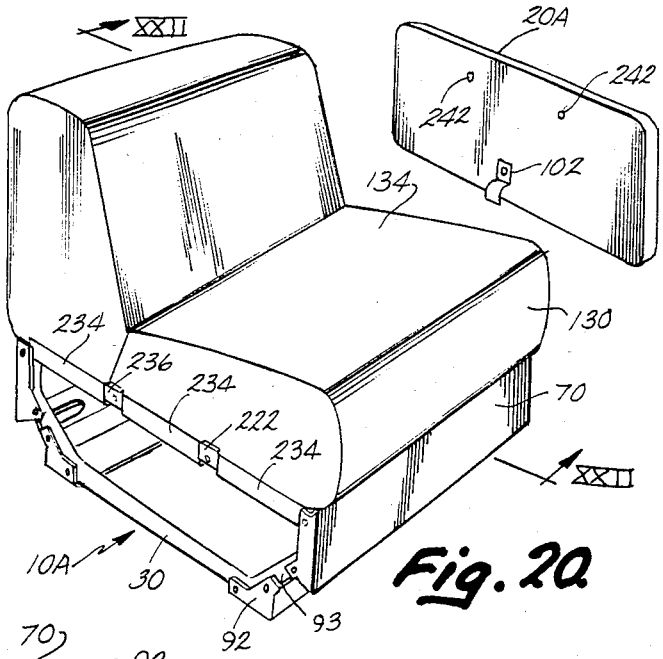
FIG. 20 is an exploded perspective view of a partially assembled chair using the alternative embodiment base of FIG. 18 showing an alternative upholstery securing strip.

In the preferred embodiment shown in FIG. 20 side hooks 156 are each separated into three elongated sections 234, instead of a single elongated hook element, by breaks 236 which allow each individual hook section 234 to be hooked individually under vertical flange 222. As shown in FIG. 20, breaks 236 are wide enough that a portion of vertical flange 222 is exposed at each break 236. However, in an alternative embodiment, breaks 236 can be very narrow so that hook section 234 are simply separated without exposing vertical flange 222.

Figure 21:
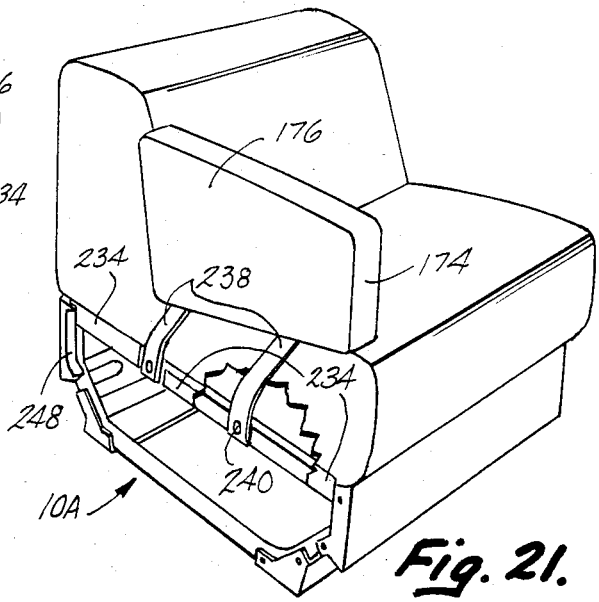
FIG. 21 is a perspective view of a chair with the base runner of FIG. 18 and an alternative center arm.

The wider separation in breaks 236 allows the use of another intermediate arm member 174 is shown in FIG. 21. Arm member 174 has a body 176 from which depend a pair of spaced support beams 238. Support beams 238 are flat bars which are spaced the same distance as the spacing of side hook breaks 236. Support beams 238 are bolted at their lower end by a pair of bolts 240 to vertical flange 22 through apertures 230. Therefore, intermediate arm member 174 is supported directly by base frame 10 instead of indirectly through support element 12. Support beams 238 are sufficiently thin that they do not interfere with the ganging together of two modular furniture assemblies 1.

Figure 20A:
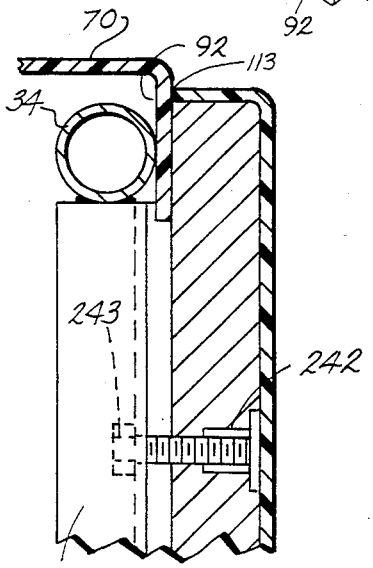
FIG. 20*a* is a fragmentary, plan sectional view of the joint between a front shroud end panel and the alternative base frame of FIG. 18, taken along plane XX—XX of FIG. 20.

In embodiments using cross beam 220, end panels 20A as shown in FIG. 21 may be used. Each end panel 20A has an inside 100 and core 108 as described above, and has a single connecting clamp 102 located adjacent its base that is spaced intermediate its two sides. A pair of spaced nuts 242, FIG. 20A, are embedded in core 108 in a conventional manner and are positioned at a height corresponding to the distance beam 220 is raised above sled base 30. Nuts 242 are spaced to correspond to the spacing between side hook breaks 236 so that end panel 20A may be bolted to cross beam 220, FIG. 20A, by bolts 243 passing through apertures 230.

Chair of FIG. 23

FIG. 23 shows how the basic elements described above can be varied slightly to create a somewhat different furniture unit, in this case a triangular shaped corner chair 1B. It can be ganged between two units 1 as described above, for example, to provide a modular seating assembly which goes around a corner.

In this embodiment, the connecting sections **36*a* of base frames 10B extend at a right angle to upright sections 34, but do not extend at a right angle to floor engaging base 30 as in base frame 10. Connecting sections 36*a* extend parallel to one another, but the angle connecting sections 36*a* form relative to floor engaging base 30 is determined by the degree of angle or wedging desired in furniture assembly 1B. This degree of angle is readily discernable by one skilled in the art when the desired amount of wedging is determined. For example, if connecting sections 36*a* are angled 11.25° away from a right angle with base frame 30, a wedge shaped furniture assembly will be provided that has a 22.5° wedge overall. A set of wedged base frames 10B are interchangeable between inside and outside turning wedges. An inside turn is one in which the front of the furniture assembly 1 is narrower than the back portion, while an outside turn is one in which the front portion is wider than the back portion of the furniture assembly. Although each base frame 10B cannot be interchanged from side to side of a single modular unit 1B, a set of base frames 10B can be turned around to switch from an inside to an outside set of base frames. Also, base frames 10B can be used with different types of support elements 12** that are wedge shaped.

As shown in FIG. 23, support element 12 is similar to that of the embodiment shown in FIG. 1, with the exception that chair seat support element 12 is wedge shaped. Therefore, front connecting area 40 is much narrower than back connecting area 42 and support element 12 has angled sides 56 joining front and back connecting areas 40, 42. As point out above, wedge shaped support element 12 can be inwardly wedged or outwardly wedged.

In the wedge shaped embodiment depicted in FIG. 23, shroud 16 and 18 are the same as those described above with the exception that front shroud 16 is much narrower than shroud 18 and that sides 92 form an angle other than a right angle relative to front face 70. Since the furniture assembly 1B of FIG. 23 has an inward turn, sides 92 on front shroud plate 16 are flared outward relative to front face 70 to form a wedge shape of the desired angle. Similarly, back shroud plate 18 has slides 92 which are flared inward in order to produce the desired wedge angle. In wedge shaped furniture having an outward bend, the flaring and relative widths of shroud plate 16 and 18 are simply reversed.

While unit 1B has been described with a base frame 10B having a rod cross piece 38, the angle iron cross piece 220 of base frame 10A could be used in its place and indeed is considered preferable for the reasons discussed above.

As noted above, the chair 1B of FIG. 23 also uses an armless end panel 20B, as shown. However, there is no unique relationship between a triangular chair and an armless end panel, and the latter could be used on any of the various other furniture units described herein. Indeed, it might not be used at all on chair 1B if the latter is to be ganged to another unit or either side.

Bench (or Table) of FIG. 24

FIG. 24 illustrates yet another embodiment employing the basic principles of this invention. Either a table or a bench can be made using the components shown in FIG. 24. Either can be ganged to other furniture units in the manner described above.

As shown in FIG. 24 support element 12A is a table. Central support area 44 is a vacuum-formed ABS horizontal table surface 58. Depressed in the center of table surface 58 is a rectangular recess 60 in which a surface insert 62 may be secured in order to provide a contrasting surface relative to the remainder of support element 12A. Table 12A also includes sides 64 to produce an enclosed cap-like element that does not require an upholstery covering to provide a finished appearance. A plywood or like material platform 65 with depending legs 66 is glued within support element 12A. Legs 66 are bolted to frames 10 to allow connecting areas 40, 42 to smoothly abut shrouds 16 and 18.

An alternative preferred embodiment support depicted in FIG. 24 is a bench support element 12B. Bench support element 12B has a smooth horizontal central supporting area 44 that forms smoothly curved joints with front and back connecting areas 40, 42. Cushion 120B and upholstery 22B for bench support 12B conform in shape thereto, but are otherwise made in accordance with their alternative embodiment counterparts described above.

As above, alternative base frames 10A or 10C could be used, rather than base frames 10 as shown.

Figure 27:
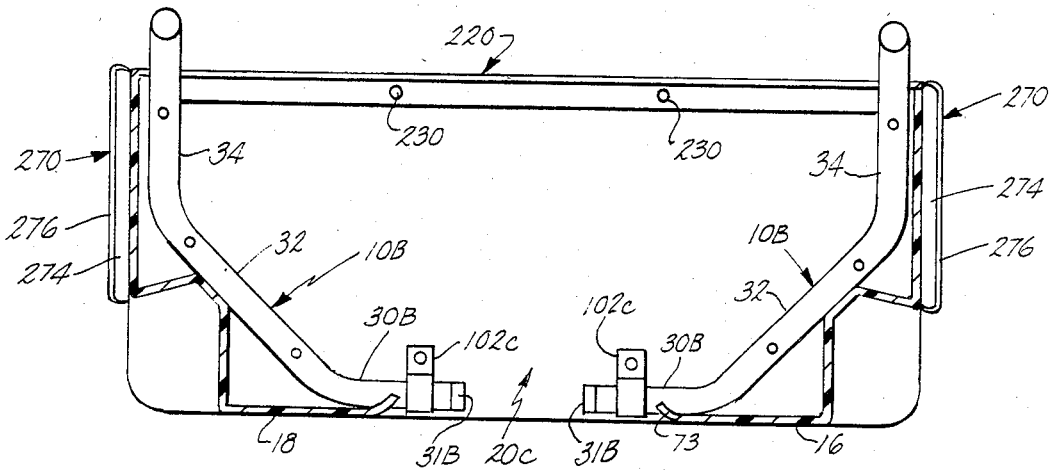
FIG. 27 is a sectional view of the base frame, shroud and end panel assembly of FIG. 25 taken along plane XXVII—XXVII.
Figure 25:
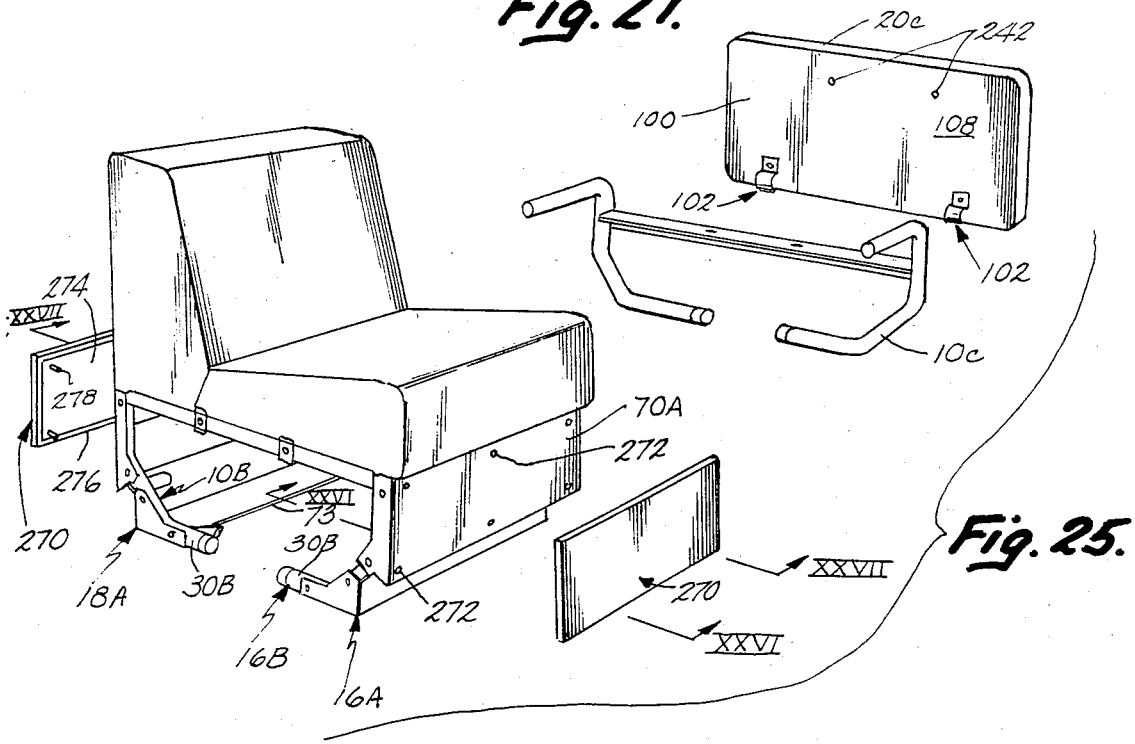
FIG. 25 is an exploded perspective view of a chair having an alternative embodiment base frame and an alternative embodiment shroud cover panel added.
Figure 26:
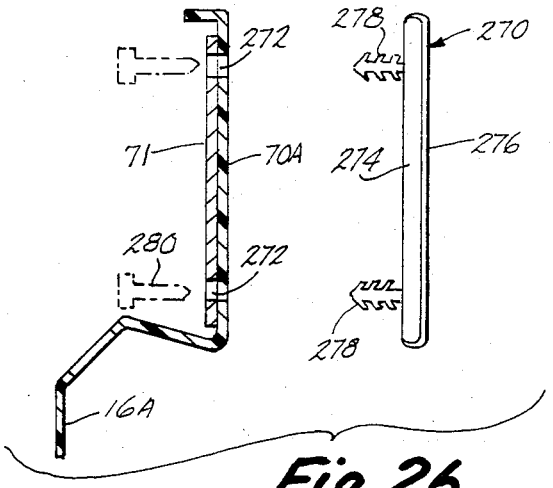
FIG. 26 is an exploded sectional view taken along plane XXVI—XXVI of FIG. 25 showing alternative methods of securing a shroud cover panel.

Alternative Base Frame and Cover Panel of FIGS. 25–27

FIGS. 25 and 27 show still another base frame 10B embodying the present invention. Base frame 10B is identical to base frame 10A with the exception that floor engaging portion 30 is not a single continuous rod, but as shown in FIG. 27, angled sections 32 each extend upwardly from a short horizontal floor engaging portion 30B. In this embodiment, an "L" shaped cross beam 220 rigidly connects two separate base frame portions 10B and provides the structural support necessary to prevent base frame portions 10B from separating. Cross beam 220 therefore rigidly maintains shrouds 16, 18 at the desired spacing as well as providing support to support element 12 in some embodiments. Base frame portions 10B require less tubing material than is required for base frame 10A which has a single elongated floor portion 30. As shown in FIG. 27, tube caps 31B are fitted into the ends of short floor engaging portions 30B to cover the sharp edge of the tube material.

As shown in FIG. 27, an end panel 20C is attached to base frames 10B to mask base frames 10B from the side. End panel 20C can be of the arm or armless version described above. End panel 20C is identical to end panel 20A, with the exception that two spaced connecting clamps 102C are located adjacent its base rather than a single connecting clamp. End panel 20C is bolted to cross beam 200 by bolts which pass through apertures 230, and each connecting clamp 102C clamps over a shortened floor extending portion 30B.

In the embodiment shown in FIGS. 25–27, a pair of upholstered cover panels 270 are secured to the outwardly facing sides of shroud **16*a*, 18*a*. Shrouds 16*a* and 18*a* are identical to shrouds 16 and 18, with the exception that faces 70*a* of shrouds 16*a*, 18*a* have spaced apertures 272 about their perimeters. Cover panel 270 has a plywood or like material core 274 to which an upholstery outer covering 276 has been attached by conventional means. As shown in FIG. 26, cover panel 270 can be secured to face 70*a* by a set of christmas tree fasteners 278, or in the alternative wood screws 280 (shown in phantom in FIG. 26) which pass through apertures 272. Other conventional means may be used to blind fasten cover panel 270 to face 70*a***.

Also shown in FIG. 26 is a reinforcing panel 71. Reinforcing panel 71 is preferably glued to the inside surface of face 70 and is made of a flat section of three eights inch thick fiberboard. Panel 71 prevents shroud plates 16, 18 from bowing or otherwise deforming. Panels 71 are preferably used with all of the above described embodiments to reinforce plates 16, 18 as is required.

FIGS. 25 and 26 show alternative shroud plates 16A and 18A that incorporate an upturned inside edge 73 on base plates 72. Inside edges 73 are upturned slightly to be removed from contact with the floor. This allows the chair to be slid along the floor without interference from edges 73. Upturned edges may also be preferably incorporated in each of the embodiments described above.

Assembly

A single modular furniture unit may be easily assembled from the various interchangeable elements. Mounting sections 36 of a pair of base frames 10, 10A or 10B or 10C are bolted to support element 12, 12A, 12B or 12C with mounting sections 36 positioned between front mounting area 40 and back mounting area 42 (FIGS. 1, 4, 22, 23 or 24). Front shroud plate 16 is bolted through sides 92 to base frame 10 et seq. so that uprights 34 extend up through notches 88. Back shroud plate 18 is screwed onto base frame in a similar fashion. In such a partially assembled condition, upholstery 22 can be secured to furniture assembly 1 as described below if the support element 12 being used requires such upholstery. If the support element 12 used is a table as shown in FIG. 24 so that upholstery 22 is not required, end panels 20 can be immediately affixed to the assembly as described below.

Upholstery hood 22 is placed over support element 12 and is pulled over any upper extremeties of support element 12. In assembling a chair as in FIGS. 1 and 23, front and back sections 130, 132 and side sections 136 are pulled up to permit access to intermediate flap 166 and fastener strip 170. The fastener strips 170 on either side of the assembly are pulled down so that rod 168 is pulled down into break 122 (FIG. 2). Rod 168 keeps upholstery central section 134 taut across its surface when flap 166 is secured to the assembly. Fastener strip 170 is pulled down on either side of the piece of furniture, then pulled upward and connected with the hook and loop fastener strip on the under surface of support element 12. Preferably, an alternative method of holding the rod 168 in position is to sew fastener strips 170 directly to the rear side extrusion 234 (FIG. 20). When hook section 234 is fastened under vertical flange 222 of cross piece 220, rod 168 is held in position between seat and back cushions.

Upholstery front section 130 is then secured to the furniture assembly as shown in FIGS. 8–10. Front section 130 is pulled down in front of front connecting area 40 so that front securing flap 142 hangs down freely as shown in FIG. 8. Securing strip 146 hangs in front of front shroud 16. Securing strip 146 is rotated so that it can be slid through the gap formed between surface 86 on shroud 16 and front connecting area 40 on support 12 (FIG. 9). Furniture assembly 1 is then tipped over onto its back so that access can be had to the inside of assembly 1 through the partially opened bottom. Alternatively, an assembler can reach in through the opened sides to gain access to the inside of the assembly.

The securing flap 142, 144 or knurled flange 152 is grasped from the inside and pulled until rounded end 150 is pulled through the gap. During this pulling operation, front securing flap 142 will compress cushion 120 in order to allow rounded end 150 to pass through the gap. Once the entire securing strip 146 is inside the furniture assembly, strip 146 is rotated so that rounded edge 150 is pressed into abutment with front connecting area 40 and thin body portion 148 is compressed into abutment with surface 86 on shroud 16 as shown in FIG. 10. During rotation of securing strip 146, round edge 150 forms a smooth bearing surface against connecting area 40. Front securing flap 142 passes through the gap between shroud 16 and front connecting area 40 of support 12, while a slight amount of compression in cushion 120 keeps the front of the upholstery in a taut condition. The identical securing strip 146 securing operation is repeated for the back of the furniture unit using back securing flap 144.

Figure 11:
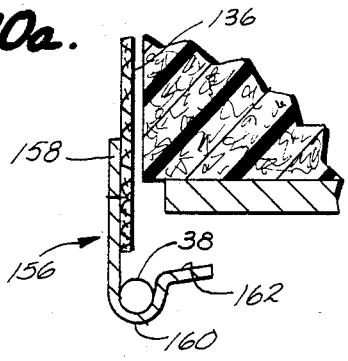
FIG. 11 is a fragmentary, sectional view of an upholstery side connector in a connected position, taken generally along plane XI—XI of FIG. 4.

Side panels 136 are pulled down and side hook 156 is hooked under cross piece 38 or vertical flange 222 of cross beam 220 (FIGS. 11 and 19). Snap flange 162 provides a leverage surface to slide under cross piece 38, or flange 222 so that when hook 156 is pivoted, it will snap over the bottom of cross piece 38 or flange 222.

End panels 20, either arm or armless are then secured to either side of furniture assembly 1, unless another unit of furniture is to be ganged against that side. The piece of furniture is rolled onto its side in order to allow access to the inside of the assembly through the partially opened bottom. Connecting clamps 102 are loosened and then positioned so that clamping flange 106 hooks over base frame 10 as shown in FIG. 5. Connecting clamps 102 are then tightened down to secure end panel 20 in place. The same procedure is conducted for the other end panel 20. In the alternative embodiments shown in FIG. 20, the above procedure is the same, with the exception that bolts 243 are slid through holes in vertical flange 222 on cross beam 220 of base 10A and bolted into nuts 242 embedded in end panel 20A, FIG. 20A. Then one connecting clamp 102 is tightened rather than three.

In the alternative embodiment shown in FIGS. 25–27, the above procedure is followed, with the exception that two connecting clamps **102*c* are secured over short floor engaging portion 30B after bolts 243 have been slid through holes 230 on vertical flange 222. Cover panels 270 are then attached to faces 70*a* of the shrouds 16*a*, 18*a*. Cover panels 270 are then simply snapped into place if christmas tree fasteners 278 are used, or alternatively, screws 280 are passed through apertures 272 and screwed into panel 274**.

Figure 6:
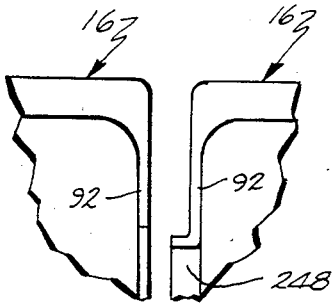
FIG. 6 is a fragmentary, top plan view of adjacent front shrouds being brought together.

The above description results in a single furniture unit 1. In order to gang several furniture units together, the above procedure is undertaken for two units, with the exception that end panel 20 is left off of complimentary or facing sides of each unit. The two units are then pushed into tight abutment with the two front shroud plates 16 and back shroud plates 18 aligned, with interlock flange 248 hooking behind a side wall 92 of its adjacent shroud (FIGS. 6 and 7).

When two units are abutted, clip notches 93 from the two adjacent shrouds align with each other to form a single aperture that allows access to adjacent base frames 10 (FIG. 12). Since clip notches 93 are in the angled ganging sections 78 of recessed corners 74, notches 93 are normally masked from view. Corner 82 depends down in front of ganging section 78 and obscures the view of notches 93 from a normal viewing level (FIGS. 2–4).

Ganger clip 24 is inserted through adjacent clip notches 93 (FIG. 12). One seat 190 of ganger clip 24 is pressed into engagement with one angled section 32 of a base frame 10. Angled section 32 contacts snap flange 200 on the free end of outer flange 198 and also recurved face 206 on one side of center flange 192. Since the diameter of angled section 32 is greater than the distance between this portion of outer flange 198 and center flange 192, outer flange 198 is deflected as clip 24 is pressed over angled section 32 (FIG. 14). Snap flange 200 and recurved face 206 form angled contact surfaces which help to spread flanges 198 and 200.

After ganger clip 24 has snapped into place over one upright section 34, the assembler presses against the base 196 of clip 24 which is furthest from the seated base frame 10. Ganger clip 24 is thus pivoted as in FIG. 14 until the other seat 190 comes into contact with the other upright section 34, and is snapped around the second base frame 10. Ganger clip 24 can be assembled onto either base runner 10 first.

A ganger clip 24 is clipped over base frames 10 on both the front and the back of assemblies 1, positively locking the two assemblies together to provide a unitary appearance to the ganged units. In order to ungang the units, a diassembler is only required to reach into recessed corner 74 and hook a finger under toggle flange 204 through access aperture 212 of recess 93 in shroud 16 or 18. Using toggle flange 204 as a lever as described above, one seat 190 of clip 24 can be unsnapped and clip 24 pivoted. The disassembler is then permitted to grasp the body of clip 24 and the other toggle flange 204 and remove it from the other base runner 10.

Units having various different support elements 12 et seq. can be ganged together as desired. For example a chair unit can be ganged on either side of a table unit. Additionally, it is to be understood that any of the different types of units can be be wedged shaped so that when these units are ganged together a bent or corner assembly can be produced. In order to attach an intermediate arm member 174 between units, these units merely need be unganged, arm member 174 secured to one of the units and the units ganged back together.

It will be recognized that with such an assembly, numerous different types of furniture pieces can be made from a relatively small number of parts. Additionally, the numerous elements are easy to assembly, transport and store so that large storage areas are not required to be dedicated to unused parts. The various pieces are readily stackable as opposed to an assembled unit. When any of the particular elements becomes damaged, it is easily removable so that it can be repaired or replaced. This is particularly true of the upholstery which often is subjected to a greater amount of wear than other elements.

Even though the furnishings can be assemblied from numerous elements at the site, the finished piece of furniture has a unitary appearance and does not appear to be tacked together from discrete elements. The individual units can be ganged or unganged as described, so that larger more cumbersome pieces of furniture are not required. When so ganged together, the different units also present a unitary appearance so that they do not appear to be made of independently ganged elements.

All of the various elements are supported by base frames 10, so that the shroud members do not have to be designed as load bearing components. Further, athough ganger clip 24 is masked from view, clip 24 is easily accessible from the exterior of the piece of furniture without moving the furniture or rolling it over onto its back. Since no disassembly of the ganged units is required to gain access to clip 24, additional units can be added or removed quickly and easily without the use of special tools or equipment.

It is to be understood that the above is a description of preferred embodiments and that various improvements or modifications can be made without departing from the spirit of the invention disclosed herein. The scope of protection is to be determined by the claims which follow and the breadth of interpretation which the law allows.

I claim:

1. A modular furniture system comprising:

a plurality of articles of furniture, said articles of furniture comprising;

a pair of elongated base frames configured to rest on a floor surface;

a first structural support member configured as a chair having a seat portion and a back portion, a second structural support member configured as a bench having a seat portion, and a third structural support member configured as a table;

means for removably and interchangably joining each of said structural support members to said base frames in order to provide a unitized structural assembly; and shroud means removably secured over said base frames and extending substantially between said structural support member and said floor surface so as to surround and mask said base frames, so that the article of furniture has an overall unitary appearance, whereby with each different structural support member joined to said frames the assembled article of furniture has a different overall configuration adapted to the support of articles dependent upon said configuration of said structural support member.

2. A modular furniture system as defined in claim 1, wherein said structural support members each comprise two spaced, generally vertically oriented mounting portions, said mounting portions spaced and connected by a configured support surface, each of said configured support surfaces spacing said mounting portions substantially the same distance as the others; said base frames including at least first and second mounting means spaced a distance corresponding to said spacing between said mounting portions on any of said support members whereby said mounting portions are secured to said mounting means and said support member is thereby mounted on said base frames.

3. A modular furniture system as defined in claim 2, wherein said shroud means includes first and second shrouds said first shroud being secured over a first side of said frames and said second shroud being secured over an opposite, second side of said frames, said first and second shrouds cooperating with said mounting portions of said structural support member to provide a unitary appearance.

4. A modular furniture system as defined in claim 3, wherein said first and second shrouds having the same configuration so as to be interchangeable.

5. A modular furniture system as defined in claim 4, further comprising ganging means for ganging together a plurality of the articles of furniture, said shroud means including means for concealing said ganging means from view but which allows access to said ganging means from the exterior of said article of furniture.

6. A modular furniture system as defined in claim 5, wherein said shroud means has a base and a recess disposed at said base, said ganging means accessible through said recess.

7. A modular furniture system as defined in claim 1, further comprising ganging means for ganging together a plurality of the articles of furniture, said shroud means including means for concealing said ganging means from view but which allows access to said ganging means from the exterior of said article of furniture.

8. A modular furniture system as defined in claim 7, wherein said shroud means has a base and a recess disposed at said base, said ganging means accessible through said recess.

9. A modular furniture system as defined in claim 1, further comprising covering means for removably covering said support member; said frames each include a cross piece extending generally from one end thereof to the other, said covering means secured to said cross piece; said covering means includes an elongated hook which hooks under said cross piece.

10. A modular furniture system as defined in claim 9, wherein each of said frames include a floor engaging portion and two generally upright portions, said cross piece extending between said upright portions and disposed above said floor engaging portion.

11. A modular furniture system as defined in claim 10, wherein said covering means includes upholstery with securing means thereon for securing a first end of said upholstery between one of said shrouds and said structural support member whereby said upholstery is hand securable and hand releasable from between said shroud and said structural support member.

12. A modular furniture system as defined in claim 11, wherein said shroud is spaced from said structural support member to form a gap therebetween, said securing means including an at least semi-rigid, relatively thin strip attached to said upholstery, said strip having an inserting position in which said strip lies in a plane generally perpendicular to said gap so that it can be inserted therethrough and having a locking position in which said strip lies in a plane generally parallel to said gap whereby it cannot pass therethrough, said strip having a thickness small enough to be inserted through said gap in said inserting position and having a width large enough to prevent removal of said strip through said gap in said locking position.

13. A modular furniture system as defined in claim 12, wherein said strip is an elongated strip extending substantially the entire length of one side of said upholstery; said strip has an enlarged gripping flange extending along a first edge of said strip; said strip has a rounded edge extending along a second edge of said strip opposite said first edge.

14. A modular furniture system as defined in claim 13, wherein said cover means further includes an upholstered cover panel secured to said shroud means whereby the exterior of said shroud means is substantially covered by said panel to present an upholstered appearance.

15. A modular furniture system as defined in claim 1, further comprising ganging means for ganging together a plurality of the articles of furniture, said ganging means including a ganging clip clipped to one of said base frames.

16. A modular furniture system as defined in claim 15, wherein said ganging clip has at least two spaced ganging seats and a toggle flange extending to one side of said ganging seats, whereby said toggle flange can be used as a lever for pivoting said ganger clip.

17. A modular furniture system as defined in claim 16, further comprising a second ganger clip connected to said base frame on a side of said base frame opposite said first ganger clip.

18. A modular furniture system as defined in claim 17, wherein each of said ganger clips includes a base from which a center flange extends, a pair of spaced outer flanges extending upwardly from said base;

said first toggle flange extending from said base laterally to the side of a first of said outer flanges and a second toggle flange extending laterally from said base to the side of a second of said outer flanges;

said outer flanges each having at their free end an outwardly bent snap flange and said center flange having at its free end recurved contact surfaces, said recurved contact surfaces being curved away from the arc of said seats.

19. A modular furniture system comprising:

a plurality of articles of furniture, each said article of furniture comprising;

a pair of elongated base frames;

one of a plurality of structural support members removably mounted on said base frames, each said structural support member having a different configuration adapted to the support of different articles, and each including means for removably joining to said base frames to provide a unitized structural assembly, whereby with each different support member joined to said frames the assembled article of furniture has a different overall configuration adapted to the support of articles dependent upon said configuration of said support member;

said structural support members each comprising two spaced, generally vertically oriented mounting portions, said mounting portions spaced and connected by a configured support surface, each of said configured support surfaces spacing said mounting portions substantially the same distance as the others of said configured support surfaces;

said base frames including at least first and second mounting means spaced a distance corresponding to said spacing between said mounting portions on any of said support members, whereby said mounting portions are secured to said mounting means and said support member is thereby mounted on said base frames;

ganging means for ganging together a plurality of the assembled articles of furniture;

shroud means removably secured over said base frames to mask said base frames so that the article of furniture has an overall unitary appearance, said shroud means including a first shroud and a second shroud having the same configuration so as to be interchangeable, said first shroud being secured over a first side of said frames and said second shroud being secured over an opposite, second side of said frames, said first and second shrouds cooperating with said mounting portions of said structural support member to provide a unitary appearance; and said first and second shrouds each having a generally vertically oriented face and a recessed corner extending below said face to provide said face with a lower edge, said recessed corner having a first generally upright wall and a second generally horizontal wall, said recessed corner having an aperture disposed therein to permit access to said ganging means, said lower edge of said face depending sufficiently such that said shroud means conceals said ganging means from normal view but provides access to said ganging means from the exterior of said article of furniture.

20. A modular furniture system as defined in claim 19, wherein said face has a lower lip, said lower lip disposed lower than at least the upper edge of said aperture in said recessed corner, so as to block said aperture from normal view.

21. A modular furniture system as defined in claim 20, wherein said shroud has a third wall, said third wall extending at an angle upward from said lower lip of said face, and said second wall extending at an upward angle from said first wall, said second and third walls joining to form a peak disposed above said lower lip of said face.

22. A modular furniture system as defined in claim 21, wherein said aperture is disposed adjacent one of said base frames and is disposed at one side of one of said shroud and opens through said side, whereby when two of the articles of furniture are abutted, said apertures of the abutted shrouds will abut and be communicative with each other.

23. A modular furniture system as defined in claim 22, wherein said shroud means includes an end cover, said end cover being secured to one of said frames and extending between said first and second shrouds.

24. A modular furniture system as defined in claim 23, wherein said first and second shrouds each have an upper flange extending upward from said face, said flange disposed behind said mounting portion of said base frame.

25. A modular furniture system as defined in claim 24, wherein said frames have the same configuration so as to be interchangeable.

26. A modular furniture as defined in claim 25, further comprising covering means for removably mounted on said support member for covering said support member.

27. A modular furniture system as defined in claim 26, wherein said runners each include a cross piece extending generally from one end thereof to the other, said covering means secured to said cross piece.

28. A modular furniture system as defined in claim 27, wherein said covering means includes an elongated hook which hooks to said cross piece.

29. A modular furniture system as defined in claim 28, wherein each of said frames include a floor engaging portion and two generally upright portions, said cross piece extending between said upright portions and disposed above said floor engaging portion.

30. A modular furniture system as defined in claim 29, wherein said covering means includes upholstery with securing means thereon for securing a first end of said upholstery between one of said shrouds and said structural support member whereby said upholstery is hand securable and hand releasable from between said shroud and said structural support member.

31. A modular furniture system as defined in claim 30, wherein said shroud is spaced from said structural support member to form a gap therebetween, said securing means including an at least semi-rigid, relatively thin strip attached to said upholstery, said strip having an inserting position in which said strip lies in a plane generally perpendicular to said gap so that it can be inserted therethrough and having a locking position in which said strip lies in a plane generally parallel to said gap whereby it cannot pass therethrough, said strip having a thickness small enough to be inserted through said gap in said inserting position and having a width large enough to prevent removal of said strip through said gap in said locking position.

32. A modular furniture system as defined in claim 31, wherein said strip is an elongated strip extending substantially the entire length of one side of said upholstery.

33. A modular furniture system as defined in claim 32, wherein said strip has an enlarged gripping flange extending along a first edge of said strip.

34. A modular furniture system as defined in claim 33, wherein said strip has a rounded edge extending along a second edge of said strip opposite said first edge.

35. A modular furniture system as defined in claim 34, wherein said securing means includes a second securing strip attached to said upholstery on a side opposite said first securing strip.

36. A modular furniture system as defined in claim 35, wherein said covering means includes a second elongated hook, said first and second elongated hooks attached to opposite sides of said upholstery, and extending generally between said first and second securing strips.

37. A modular furniture system as defined in claim 36, further comprising an arm unit secured to said support member.

38. A modular furniture system as defined in claim 37, wherein said arm unit includes a connecting bracket secured to said arm unit and secured to said support member, said bracket having a first leg extending downward from said support member, a bent portion disposed under said cross piece and a second leg extending up to said arm unit, said first and second leg spaced sufficiently to allow upholstery fabric to pass between said legs.

39. A modular furniture system as defined in claim 38, further comprising an upholstered cover panel secured to said face of each of said first and second shrouds.

40. A modular furniture system as defined in claim 36, further comprising an arm unit secured to said cross piece.

41. A modular furniture system as defined in claim 40, wherein said arm unit includes bracket means depending from said arm unit, said bracket means bolted to said cross piece.

42. A modular furniture system as defined in claim 41, wherein said ganging means includes a first ganger clip clipped to one of said base frames.

43. A modular furniture system as defined in claim 42, wherein said ganging clip has at least two spaced ganging seats and a toggle flange extending to one side of said ganging seats, whereby said toggle flange can be used as a lever for pivoting said ganger clip.

44. A modular furniture system as defined in claim 43, further comprising a second ganger clip connected to said base frame on a side of said base frame opposite said first ganger clip.

45. A modular furniture system as defined in claim 44, further comprising an upholstered cover panel secured to said face of each of said first and second shrouds.

46. An article of furniture comprising:

a pair of elongated base frames;

a structural support member removably mounted on said base frames to provide a unitized structural assembly;

ganging means for ganging together a plurality of the articles of furniture;

shroud means removably secured over said base frames to mask said base frames so that the article of furniture has an overall unitary appearance, said shroud means including a first shroud and a second shroud, said first shroud being secured over a first side of said frames and said second shroud being secured over an opposite, second side of said frames, said first and second shrouds cooperating with said mounting portions of said structural support member to provide a unitary appearance;

said first and second shrouds each having a generally vertically oriented face and a recessed corner extending below said face to provide said face with a lower edge, said recessed corner having a first generally upright wall and a second generally horizontal wall, said recessed corner having an aperture disposed therein to permit access to said ganging means, said lower edge of said face depending sufficiently such that said shroud means conceals said ganging means from normal view but provides access to said ganging means from the exterior of said article of furniture.

47. An article of furniture as defined in claim 46, wherein said face has a lower lip, said lower lip disposed lower than at least the upper edge of said aperture in said wall, so as to block said aperture from normal view.

48. An article of furniture as defined in claim 47, wherein said shroud has a third wall, said third wall extending at an angle upward from said lower lip of said face, and said second wall extending at an upward angle from said first wall, said second and third walls joining to form a peak disposed above said lower lip of said face.

49. An article of furniture as defined in claim 48, wherein said ganging means includes a first ganger clip clipped to one of said base runners.

50. An article of furniture as defined in claim 49, wherein said ganging clip has at least two spaced ganging seats and a toggle flange extending to one side of said ganging seats, whereby said toggle flange can be used as a lever for pivoting said ganger clip.

51. An article of furniture as defined in claim 50, further comprising a second ganger clip connected to said base frame on a side of said base frame opposite said first ganger clip.

52. An article of furniture as defined in claim 51, wherein said shroud means includes an end cover, said end cover secured to one of said frames and extending between said first and second shrouds.

53. An article of furniture as defined in claim 52, wherein said first and second shrouds having the same configuration so as to be interchangeable.

54. An article of furniture as defined in claim 53, wherein said frames have the same configuration so as to be interchangeable.

55. An article of furniture as defined in claim 54, wherein said shroud member includes a fourth shroud portion, said fourth shroud portion secured to one of said frames and extending between said first and second shroud portions, said third and fourth shroud portions being interchangeable.

56. An article of furniture as defined in claim 55, further comprising an upholstered cover panel secured to said face of each of said first and second shrouds.

57. An article of furniture as defined in claim 41, further comprising an upholstered cover panel secured to said face of each of said first and second shrouds.

58. A modular furniture system comprising:

a plurality of modular furniture units, each having a support base and a ganging anchor element rigidly secured to the remainder of said modular furniture unit;

ganging means for ganging together said modular furniture units, said ganging means being hand operable for ganging and unganging said furniture units;

shroud means for concealing said ganging means from view but having means providing access to said ganging means from the exterior of said furniture units without dismantling or moving said furniture units, said shroud means including a shroud wall extending about said anchor element and having a recessed area that includes said access means, said access means located to cooperate with the access means of an adjacently positioned modular furniture unit to provide simultaneous access to at least two adjacent ganging anchor elements;

said shroud means having a lower lip;

said recess having a substantially vertical back wall, a generally upwardly angled ganging wall extending from the top of said vertical wall and a generally downwardly angled connecting wall extending from said ganging wall to said lower lip;

said access means including said ganging wall having an aperture therethrough, said ganging anchor element being disposed adjacent said aperture and said aperture being disposed to abut an aperture of an adjacent modular furniture unit, said aperture being disposed at least partially above said lower lip; and said ganging means including a ganger clip selectively engaging said ganging anchor elements of adjacent modular furniture units, whereby an assembler can simultaneously pass said ganging clip through adjacently positioned ones of said recess and said access means to clamp said anchor elements of adjacent modular furniture units together, such that said ganging clip will be masked from view when so positioned.

59. A modular furniture system as defined in claim 58, wherein said ganger clip has a center flange and two spaced outer flanges, said center flange and each of said outer flanges forming a seat for one of said ganger anchor elements;

a generally planar toggle flange extending from either side of said clip, said toggle flanges extending generally perpendicular to said center flange, whereby one of two of said adjacent ganger anchor elements can be seated in said clip and one of said toggle flanges can be used as a lever to pivot said clip about said seated ganger anchor element in order to help seat or unseat the other of said ganger anchor elements in said clip.

60. An article of furniture comprising:

a furniture base defining a base wall and having an upper support area thereon;

a slot through said base wall located below said support area, said slot having a slot width;

an upholstery cover configured to cover said support area, said cover having sides; and an elongated, at least semi-rigid strip connected to a first side of said cover and extending along said first side, said strip having a strip thickness narrower than said slot width, and said strip having a strip width greater than said strip thickness and greater than said slot width, said strip having a secured position in which said strip width spans said slot and said upholstery cover biases said strip against said base wall, and said strip having a release position in which said strip thickness is aligned with said slot for passage therethrough, whereby said strip can be inserted through said slot and rotated to said secured position in which said strip width prevents removal of said strip through said slot.

61. An article of furniture as defined in claim 60, wherein said strip has an enlarged gripping flange extending along a first edge of said strip.

62. An article of furniture as defined in claim 61, wherein said strip has a rounded edge extending along a second edge of said strip opposite said first edge.

63. An article of furniture as defined in claim 62, wherein said enlarged gripping flange has a triangular configuration and a knurled surface;

said side of said upholstery having depending connecting flap, said connecting strip connected to said depending flaps.

64. An article of furniture as defined in claim 63, wherein said upholstery cover has at least one other side;

an elongated hook connected to said other side, said hook extending along substantially the entire length of said side;

said article of furniture including a cross piece located below said support area;

said hook hooking under said cross piece.

65. An article of furniture as defined in claim 64, wherein said hook has extending along its free end a snap flange extending to the side of said hook free end.

66. An article of furniture as defined in claim 65, further comprising a base portion disposed beneath said support area; an upholstered cover panel secured to said base portion so as to substantially cover said base portion and present an overall upholstered appearance.

* * * * *

UNITED STATES PATENT AND TRADEMARK OFFICE

CERTIFICATE OF CORRECTION

PATENT NO. : 4,602,817

DATED : July 29, 1986

INVENTOR(S) : William B. Raftery

It is certified that error appears in the above-identified patent and that said Letters Patent is hereby corrected as shown below:

Column 2, line 36:
"a" (first occurrence) should be --as--

Column 6, line 33:
after "have" insert --a--

Column 7, line 35:
after "154" delete --is--

Column 7, line 61:
"entending" should be --extending--

Column 8, line 41:
"curved" should be --curve--

Column 9, line 2:
after "using" delete --a--

Column 11, line 7:
"point" should be --pointed--

Column 11, line 44:
"support" should be --supporting--

Column 15, line 26:
"assembly" should be --assemble--

UNITED STATES PATENT AND TRADEMARK OFFICE

CERTIFICATE OF CORRECTION

PATENT NO. : 4,602,817

DATED : July 29, 1986

INVENTOR(S) : William B. Raftery

It is certified that error appears in the above-identified patent and that said Letters Patent is hereby corrected as shown below:

Column 15, line 39:
"described" should be --desired--

Column 15, line 46:
"athough" should be --although--

Column 19, line 20:
after "furniture" insert --system--

Signed and Sealed this

Twenty-seventh Day of January, 1987

*Attest:*

DONALD J. QUIGG

*Attesting Officer* *Commissioner of Patents and Trademarks*